US005997239A

United States Patent [19]

Mimura et al.

[11] Patent Number: 5,997,239

[45] Date of Patent: Dec. 7, 1999

[54] SHEET HANDLING APPARATUS

[75] Inventors: Hideki Mimura; Kazuyuki Kubota; Tsuyoshi Asahara; Hiroshi Saegusa, all of Yamanashi-ken, Japan

[73] Assignee: Nisca Corporation, Yamanashiken, Japan

[21] Appl. No.: 09/022,625

[22] Filed: Feb. 12, 1998

[30] Foreign Application Priority Data

| | | | |
|---|---|---|---|
| Feb. 13, 1997 | [JP] | Japan | 9-029089 |
| Feb. 13, 1997 | [JP] | Japan | 9-029090 |
| May 26, 1997 | [JP] | Japan | 9-153025 |

[51] Int. Cl.[6] ..... B65H 29/46

[52] U.S. Cl. ..... 414/789.9; 270/58.11

[58] Field of Search ..... 270/58.11, 58.12, 270/58.13, 58.14, 58.16, 58.08, 58.07; 414/790.2, 790.8

[56] References Cited

U.S. PATENT DOCUMENTS

| | | | |
|---|---|---|---|
| 5,384,634 | 1/1995 | Takehara et al. | 355/323 |
| 5,447,298 | 9/1995 | Watanabe et al. | 270/58.11 |
| 5,651,537 | 7/1997 | Morii et al. | 270/58.11 |
| 5,685,529 | 11/1997 | McFarland | 270/58.11 |

FOREIGN PATENT DOCUMENTS

| | | |
|---|---|---|
| 4-288292 | 10/1992 | Japan . |
| 6-9142 | 1/1994 | Japan . |

*Primary Examiner*—Christopher P. Ellis
*Assistant Examiner*—Gregory A. Morse
*Attorney, Agent, or Firm*—Sixbey, Friedman, Leedom & Ferguson; Donald R. Studebaker

[57] ABSTRACT

A sheet handling apparatus receives on a handling tray a plurality of sheets discharged from an image recording apparatus such as a printer, a copier or the like in a first direction, thereby forming a sheet stack of a series of sheets on the handling tray, and transfers the sheet stack onto an accumulation tray which is disposed with respect to the handling tray in a second direction which intersects the first direction. A first gripper grips the sheet stack on the handling tray and transfers it toward the accumulation tray in the second direction, and a second gripper which grips the sheet stack at an edge portion on the image recording apparatus side receives the sheet stack from the first transfer means after the first transfer means transfers the sheet stack by a predetermined distance in the second direction and transfers the sheet stack in the second direction.

23 Claims, 22 Drawing Sheets

SHEET HANDLING APPARATUS

BACKGROUND OF THE INVENTION

1. Field of the Invention

This invention relates to a sheet handling apparatus which receives a series of recording sheets discharged from an image recording apparatus such as a copier, a printer or the like on a handling tray in a stack and transfers the sheet stack thus formed to an accumulation tray one by one to stack a plurality of sheet stacks on the accumulation tray.

2. Description of the Related Art

In such a sheet handling apparatus, generally a series of sheets discharged from the image recording apparatus onto the handling tray are lined up to form a sheet stack and the sheet stack is transferred to an accumulation tray, after being stapled as required, so that the operator can easily remove the sheet stack. On the accumulation tray, a plurality of such sheet stacks are stacked one by one.

As disclosed for instance in Japanese Unexamined Patent Publication No. 6(1994)-9142, sheet handling apparatus in which a sheet stack on the handling tray is transferred to the accumulation tray in a direction which intersects the direction in which the sheets are discharged onto the handling tray referred to as "the discharge direction", herein. In the apparatus, the sheet stack is transferred to the accumulation tray by an ejector lever which ejects the sheet stack toward the accumulation tray and a conveyor roller pair which conveys the sheet stack while pinching the sheet stack between a pair of conveyor rollers. Further an apparatus in which a gripper grips a leading end portion of the sheet stack, draws the sheet stack out from the handling tray and transfers it to the accumulation tray is known.

The sheet handling apparatus in which the sheet stack is transferred by rotation of the roller pair is disadvantageous in that it is difficult to transfer and release the sheet stack onto the accumulation tray with the edges of the sheets lined up and that it is difficult, when the sheet stacks are stapled, to stack the sheet stacks so that the staple on the preceding sheet stack does not interfere with the edge of the following sheet stack. Especially as the handling speed increases, the transfer mechanism must operate at a higher speed to keep of the sheet stack lined up and increase the transfer efficiency. Further it is preferred that the transfer mechanism be arranged not to interfere with the operator when the operator takes out the sheet stacks on the accumulation tray.

Further in such sheet handling apparatuses, it is often required to staple the sheet stack. As disclosed, for instance, in Japanese Unexamined Patent Publication Nos. 6(1994)-9142 and 4(1992)-288292, a sheet handling apparatus which is provided with a pair of staplers in order to staple the sheet stack in two positions is known. In the apparatus, at least one of the staplers is arranged to be movable so that the stapling positions on the sheet stack can be changed according to the size of the sheets.

However providing a pair of staplers, at least one of which requires a mechanism for moving, complicates the structure and increases the overall size of the apparatus.

Further an attempt to staple the sheet stack in two positions by a single stapler, by which the sheet stack is first stapled in a first position and then in a second position, the portion may result in of the sheet stack between the first stapling position and the second stapling position bulging.

That is, when the sheet stack is transferred to bring the second position to the stapler after the sheet stack is stapled in the first stapling position, a part of the sheet stack near the staple is pressed by the staple whereas the part of the sheet stack remote from the staple is free. Accordingly when there are formed spaces between the sheets at the part remote from the staple, the sheets near the surface of the sheet stack bulge outward and when the sheet stack is stapled in the second position with the bulge left as it is, a bulge is formed in the bound sheet stack between the first and second stapling positions. Further when the part between the first and second stapling positions of the sheet stack which has been stapled in the first stapling position and is to be stapled in the second stapling position is not straight, the length of the upper surface of the sheet stack between the first and second stapling positions becomes larger than that of the lower surface of the sheet stack and a bulge is formed in the bound sheet stack due to the difference in length. Further when a sheet stack which has been stapled in the first stapling position is conveyed by rollers, the conveying speed fluctuates in the direction of thickness of the sheet stack, which forms a similar bulge due to the fact that the sheet stack has been stapled in the first stapling position, and when the sheet stack is stapled in the second position with the bulge left as it is, a bulge is formed in the bound sheet stack between the first and second stapling positions.

Further when the sheet stack is stapled in a first stapling position remote from the part where it is held and then in a second stapling position nearer to the part where it is held, a bulge is more apt to be formed. However when the sheet stack is transferred to be stapled first in a position nearer to the part where it is held and then in a second stapling position remote therefrom, the sheet stack must be reciprocated back and forth, which increases the stapling time and reduces the throughput of the apparatus.

SUMMARY OF THE INVENTION

In view of the foregoing observations and description, the primary object of the present invention is to provide a sheet handling apparatus which can efficiently transfer the sheet stack on the handling tray to the accumulation tray with the sheets kept in an aligned state and and which has a simple sheet transfer mechanism.

Another object of the present invention is to provide a sheet handling apparatus which can efficiently staple the sheet stack in first and second stapling positions without forming a bulge between the stapling positions.

In accordance with the present invention, there is provided a sheet handling apparatus which receives on a handling tray a plurality of sheets discharged from an image recording apparatus such as a printer, a copier or the like in a first direction, thereby forming a sheet stack of a series of sheets on the handling tray, and transfers the sheet stack onto an accumulation tray which is disposed with respect to the handling tray in a second direction which intersects the first direction, said sheet handling apparatus comprising

- a first transfer means which transfers the sheet stack on the handling tray toward the accumulation tray in the second direction, and
- a second transfer means in the form of a gripper which grips the sheet stack at an edge portion on the image recording apparatus side, receives the sheet stack from the first transfer means after the first transfer means transfers the sheet stack by a predetermined distance in the second direction and transfers the sheet stack in the second direction.

By virtue of the second transfer means which grips the sheet stack when transferring the same, the sheet stack can be held lined up during transfer.

Though the first transfer means may comprise an ejector such as an ejector rod which pushes the sheet stack in the second direction, preferably the first transfer means comprises a gripper which grips the sheet stack at an upstream edge portion as seen in the second direction.

With this arrangement, the sheet stack can be more surely held lined up during transfer.

Preferably the second transfer means is moved along a path which is disposed outside of the accumulation tray on the side of a reference surface of the accumulation tray when transferring the sheet stack, the reference surface being a surface which is positioned on the image recording apparatus side of the accumulation tray and against which the sheet stacks are brought into abutment to line up the sheet stacks.

With this arrangement, the sheet stacks on the accumulation tray can be removed without fear that the second transfer means interferes with the operator.

Further it is preferred that the second transfer means is normally held in a home position beside the handling tray.

With this arrangement, working efficiency of the second transfer means is improved and throughput of the apparatus is increased.

Further it is preferred that a reference position on the accumulation tray on the basis of which the sheet stacks are stacked on the accumulation tray is shifted in the first direction from a reference position on the handling tray on the basis of which the sheets are stacked on the handling tray.

Generally the handling tray and the accumulation tray are inclined and the sheets and the sheet stacks are stacked respectively on the trays on the basis of the lower side ends of the trays. In the case of the handling tray, the sheets are lined up in a direction perpendicular to the surface of the handling tray whereas in the case of the accumulation tray where a large number of sheet stacks are stacked, the sheet stacks are lined up not in a direction perpendicular to the surface of the accumulation tray but in a vertical direction. Accordingly when the reference position of the accumulation tray is shifted from that of the handling tray, a following sheet stack can be stacked on the preceding sheet stack on the accumulation tray without the staples on the preceding sheet stack interfering with the end of the following sheet stack and at the same time the sheet stack can be easily transferred to the accumulation tray in place.

It is preferred that the second transfer means be arranged to be able to move the sheet stack in a direction intersecting the second direction.

With this arrangement, the sheet stack can be transferred to the accumulation tray in place irrespective of whether the reference position of the accumulation tray is shifted from that of the handling tray.

It is preferred that the second transfer means comprises upper and lower pinch levers which respectively press the upper and lower surfaces of the sheet stack in a surface contact.

This arrangement is advantageous in that the sheet stack can be transferred with the sheet stack held in alignment more surely.

It is preferred that the second transfer means releases the sheet stack onto the accumulation tray in a state where at least the edge portion gripped by the second transfer means is held horizontally.

This arrangement facilitates stacking the sheet stacks on the accumulation tray in order.

It is preferred that the second transfer means comprises a pair of pinch levers which are opened and closed by an opening and closing mechanism and are closed to press the sheet stack on opposite sides thereof, a rotating mechanism which rotates the pinch levers gripping therebetween the sheet stack to move the sheet stack in a direction intersecting the second direction, and a transfer mechanism which transfers the pinch levers in the second direction, wherein the pinch levers are closed by the opening and closing mechanism to grip the sheet stack in a home position of the second transfer means, where the second transfer means receives the sheet stack, transferred by the transfer mechanism to a release position gripping the sheet stack, rotated by the rotating mechanism in the direction intersecting the second direction, and opened to release the sheet stack onto the accumulation tray.

With this arrangement, the second transfer means can be simple in structure.

The sheet handling apparatus of this invention may comprise a stapler which staples the sheet stack on the handling tray in first and second stapling positions in an edge portion of the sheet stack, and in this case, it is preferred that the second transfer means grips the portion of the sheet stack between the first and second stapling positions inclusive of the first stapling position when the stapler staples the sheet stack in the second stapling position after stapling in the first stapling position.

With this arrangement, a bulge between the first and second stapling position is flattened by the second transfer means before stapling in the second stapling position, whereby no bulge is formed on the bound sheet stack.

In one embodiment, the sheet handling apparatus of this invention comprises a stapler which staples the sheet stack on the handling tray in first and second stapling positions in an edge portion of the sheet stack, and the second transfer means receives from the first transfer means a sheet stack which has been stapled in the first stapling position gripping the sheet stack at a portion between the first and second stapling positions inclusive of the first stapling position and transfers the sheet stack to bring the second stapling position to the stapler.

Also with this arrangement, a bulge between the first and second stapling position is flattened by the second transfer means before stapling in the second stapling position, whereby no bulge is formed on the bound sheet stack.

In the case where not only the second transfer means but also the first transfer means comprises a gripper, the sheet handling apparatus may further comprise a first control means which controls transfer action of the first transfer means, a second control means which controls transfer action of the second transfer means, and a timing setting means which sets the timing at which the sheet stack is delivered from the first transfer means to the second transfer means.

In one embodiment, the first control means sets the delivery position of the first transfer means where it delivers the sheet stack to the second transfer means by setting variable the distance by which the first transfer means transfers the sheet stack by the timing set by the timing setting means and the second control means keeps fixed the receiving position of the second transfer means where it receives the sheet stack.

In another embodiment, the second control means sets variable the distance by which the second transfer means transfers the sheet stack from the receiving position where it receives the sheet stack at the timing set by the timing setting means to the release position where it releases the sheet stack onto the accumulation tray and the first control means keeps fixed the delivery position of the first transfer means where it delivers the sheet stack to the second transfer means.

In still another embodiment, the first control means sets variable the distance by which the first transfer means transfers the sheet stack from the handling tray to the delivery position where it delivers the sheet stack to the second transfer means and the second control means sets variable the distance by which the second transfer means transfers the sheet stack from the receiving position where it receives the sheet stack to the release position where it releases the sheet stack onto the accumulation tray.

It is preferred that the first and second transfer means be arranged to grip different edge portions of the sheet stack.

More preferably the edge portions of the sheet stack gripper by the first and second transfer means be perpendicular to each other.

In this case, it is preferred that the second transfer means is movable between a retracted position and a projecting position in a direction perpendicular to the second direction.

The accumulation tray may be provided with a mechanism for moving up and down the accumulation tray.

The first and second transfer means may transfer the sheet stack in the same direction.

DESCRIPTION OF THE PREFERRED EMBODIMENT

Figure 1:
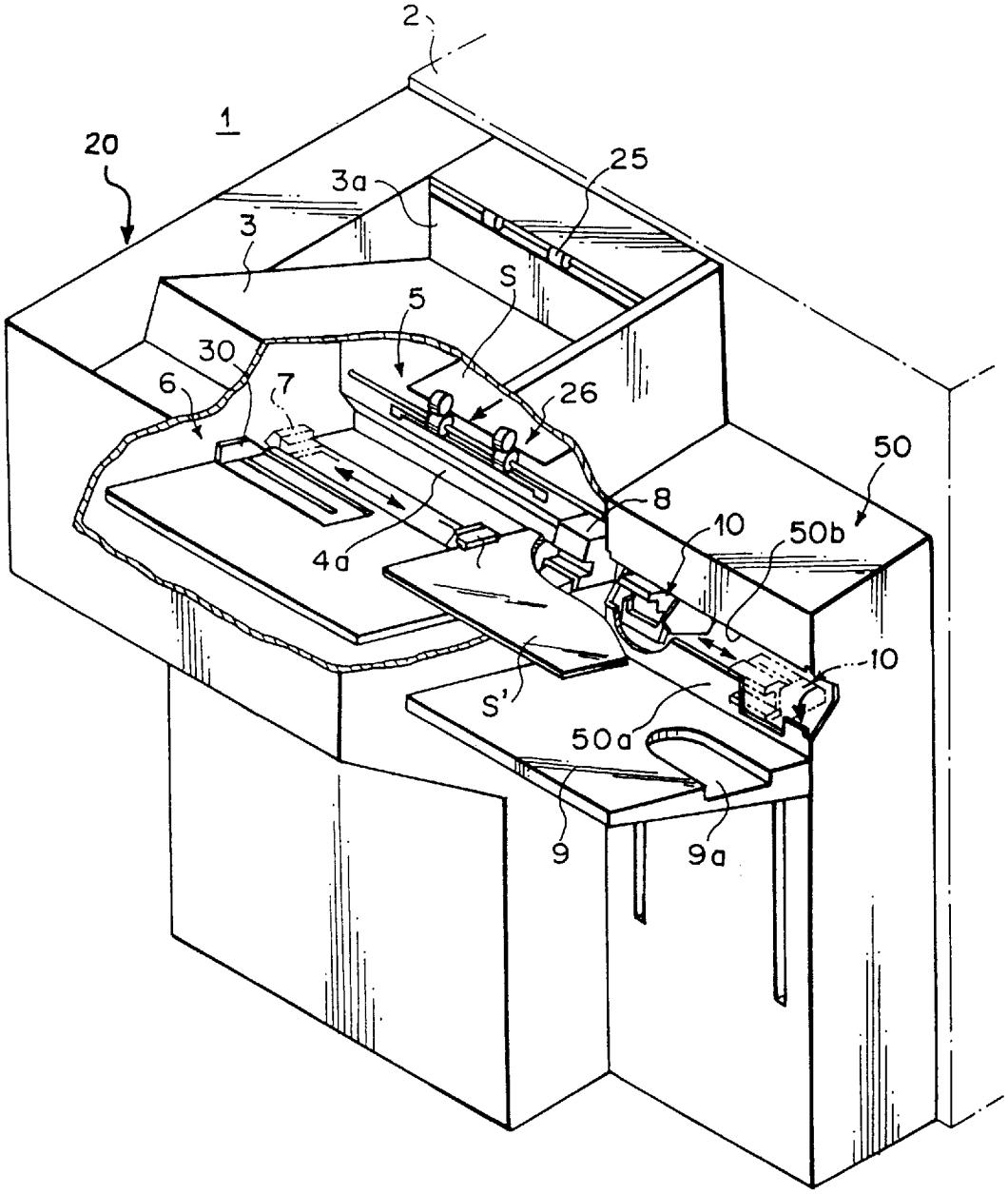
FIG. 1 is a perspective view partly cut away showing a sheet handling system provided with a sheet handling apparatus in accordance with an embodiment of the present invention.

In FIG. 1, reference numeral 1 denotes a sheet handling apparatus in accordance with an embodiment of the present invention for handling recording sheets S discharged from an image recording apparatus 2 such as a copier, printer, facsimile or the like in sequence. The sheet handling apparatus 1 is housed in first and second housings 20 and 50.

The sheet handling apparatus 1 comprises an upstream transfer means 5 which transfers recording sheets S discharged from the image recording apparatus 2 in sequence selectively to a top tray 3 or a handling tray 4, a lineup means 6 which lines up the edges of the recording sheets S stacked on the handling tray 4, a first gripper 7 which grips the lined sheet stack S' and transfers the same, a stapler 8 which staples the sheet stack S' held by the first gripper 7, an accumulation tray 9 which is movable up and down and on which the stapled sheet stacks S' are stacked, a second gripper 10 which receives the stapled sheet stack S' from the first gripper 7 and transfers the sheet stack S' to a predetermined position on the accumulation tray 9, a sheet level detecting means 11 which detects the level of the sheet stacks S' stacked on the accumulation tray 9, and a lift means 12 which moves the accumulation tray 9 up and down.

Figure 2:
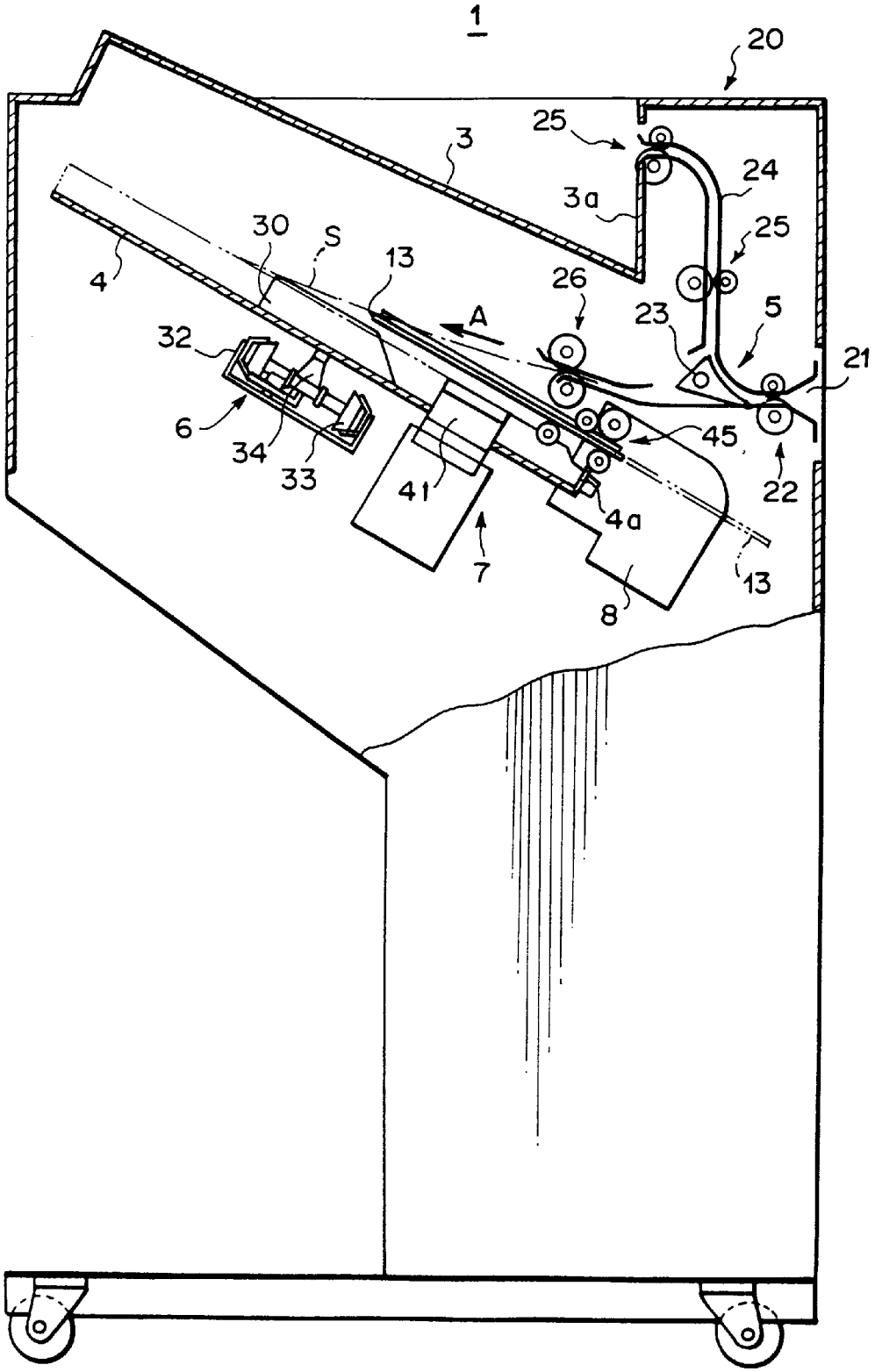
FIG. 2 is a side view partly cut away showing the sheet handling apparatus.

As shown in FIG. 2, the upstream transfer means 5 has an inlet slot 21 open in the back side of the housing 20 of the sheet handling apparatus 1. The inlet slot 21 is in alignment with a sheet discharge slot (not shown) of the image recording apparatus 2 and receives the recording sheet S discharged from the image recording apparatus 2. A conveyor roller pair 22 and a flapper 23 for switching the sheet transfer path between a first transfer path leading to the top tray 3 and a second transfer path leading to the handling tray 4 are disposed downstream the inlet slot 21 in this order from the upstream side. The first transfer path is formed by guide plates 24 and two conveyor roller pairs 25, and the second transfer path is formed by guide plates 24 and a discharge roller pair 26.

The top tray 3 is formed integrally with the top surface of the first housing 20 of the sheet handling apparatus 1 and is inclined upward from the upstream side to the downstream side with respect to the direction in which the recording sheet S is discharged to the top tray 3. A vertical wall 3*a* is defined at the upstream end of the top tray 3 and a slot through which the recording sheet S is discharged to the top tray 3 is formed in an upper portion of the vertical wall 3*a*. Recording sheets S are simply stacked on the top tray 3 in the order of discharge.

The handling tray 4 is disposed below the top tray 3 and is inclined in parallel to the top tray 3. A series of recording sheets S to be stapled together are conveyed in sequence to the handling tray 4 in a direction of arrow A by the discharge roller pair 26 disposed at the end of the second transfer path which is substantially linear.

The handling tray 4 has a wall surface 4*a* at the upstream side end thereof. The wall surface 4*a* extends in perpendicular to the direction A of discharge of the recording sheet S and functions as a reference surface for lining up the rear edges of the recording sheets S.

The rear edges of the recording sheets S stacked on the handling tray 4 are brought into abutment against the reference surface 4*a* of the handling tray 4 by inclination of the handling tray 4, whereby the recording sheets S are lined up in the longitudinal direction (the direction A of discharge). Lineup of the recording sheets S in the transverse direction is effected by bringing one side edge of the recording sheets S into abutment against a surface of a reference plate 31 (FIGS. 3 and 4), which is movable up and down, by a lineup member 30 which pushes the other side edges of the recording sheets S toward the reference plate 31.

A mechanism for moving the lineup member 30 will be described with reference to FIGS. 2 and 3, hereinbelow. A pair of rails 32 extend in the direction of width of the handling tray 4 therebelow. A holding member 34 which holds the lineup member 30 is engaged with the rails 32 to be movable along the rails 32 by way of conical rollers 33 on opposite sides thereof. An endless belt 36 is passed around a pair of pulleys 35 and is fixed to the holding member 34. One of the pulleys 35 is driven by a lineup motor (not shown) to move the holding member 34 and the lineup member 30 held thereon along the rails 32 by way of the belt 36.

The reference plate 31 may be moved up and down by any known mechanism. For example, a pin fixed to the reference plate 31 is inserted into a vertical guide slot so that the reference plate 31 is movable up and down along the guide slot and the reference plate 31 is engaged with opposite ends of a bar which is moved up and down by an actuator.

The lineup member 30 is held in a retracted position away from the recording sheets S while the recording sheets S are transferred to the handling tray 4 in sequence. After a predetermined number of recording sheets S are stacked on the handling tray 4, the lineup member 30 is moved toward the sheet stack S' to bring the side edges of the sheets S into abutment against the surface of the reference plate 31, thereby lining up the edges of the recording sheets S.

Figure 4:
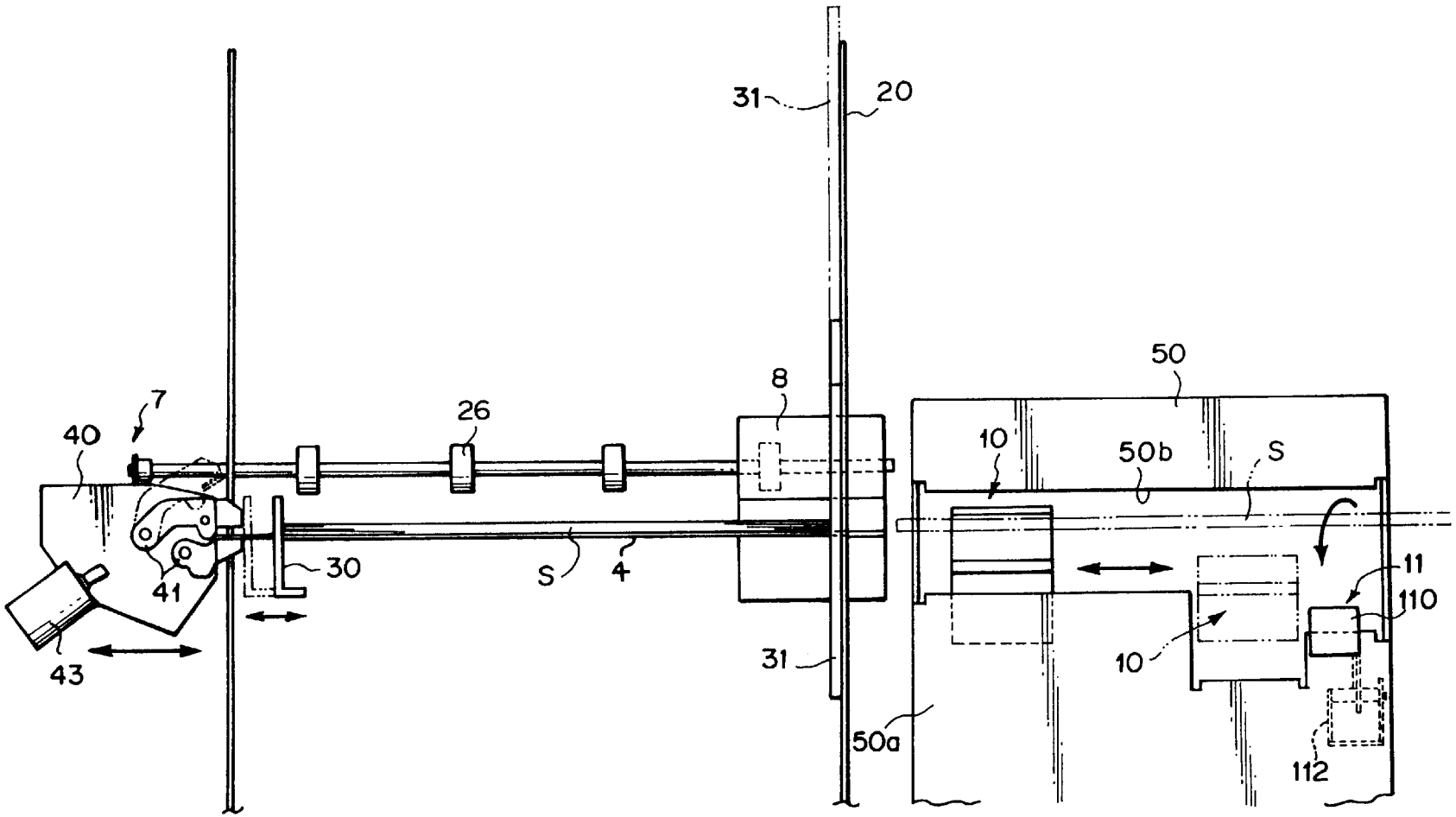
FIG. 4 is a schematic front view showing the sheet handling apparatus and the accumulation handling apparatus.

The first gripper 7 grips the rear side edge portion of the sheet stack S' which has been lined up on the handling tray 4 and transfers the sheet stack S' in the direction of arrow B which intersects the direction A of discharge of the recording sheets S. As shown in FIG. 4, the first gripper 7 comprises upper and lower pinch levers 41 which are supported on a movable frame 40 to be opened and closed. Though not shown in detail, the pinch levers 41 are closed to pinch or grip the rear side edge portion of the sheet stack S' by a gripper solenoid 43. The pinch levers 41 are moved back and forth by a suitable mechanism. For example, the mechanism may comprise a guide for guiding the movable frame 40, a pair of pulleys one which is driven by a motor and a belt which is passed around the pulleys and to which the movable frame 40 is fixed.

Figure 5:
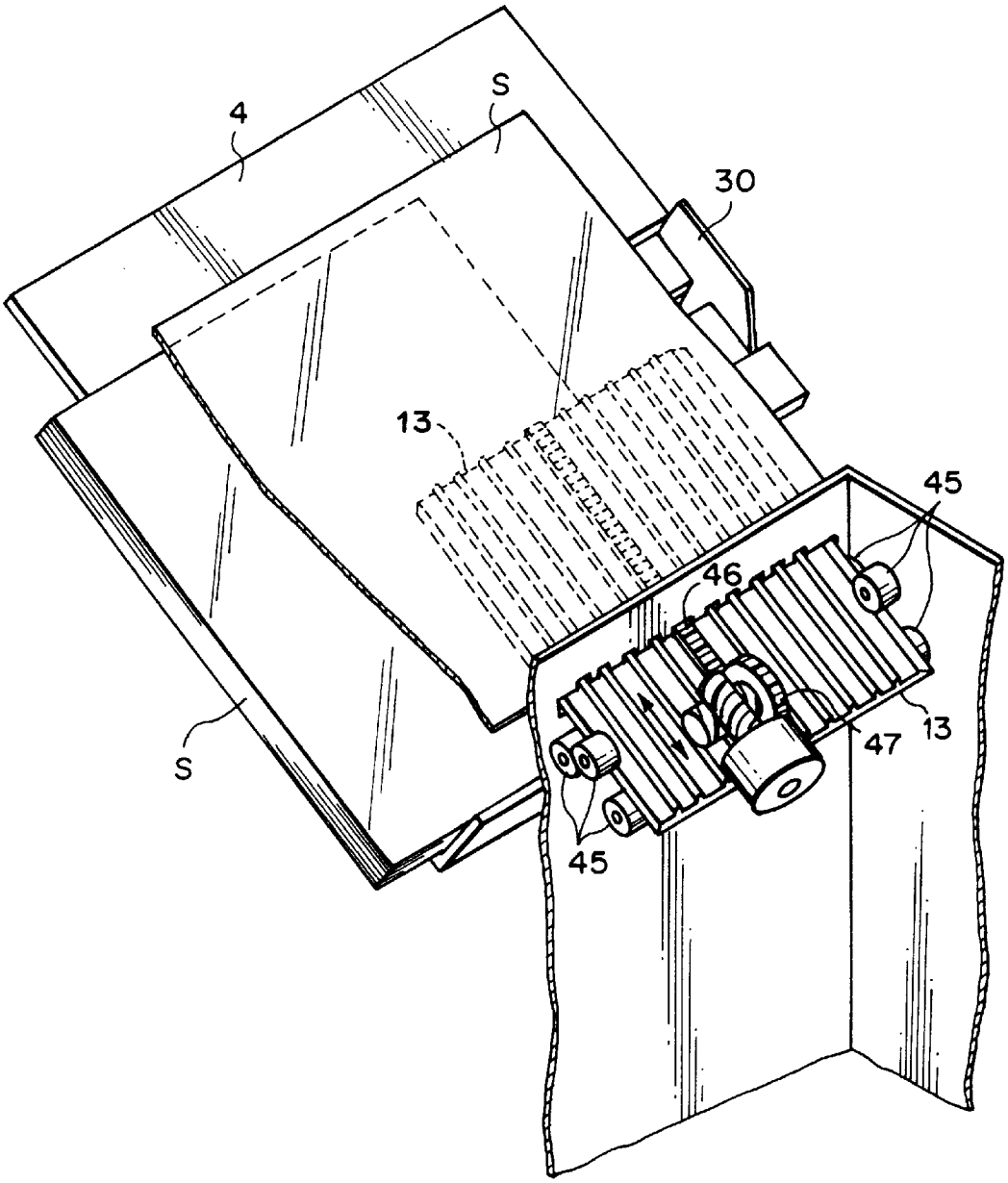
FIG. 5 is a perspective view of the auxiliary tray.

AS shown in FIG. 2, an auxiliary tray 13 in the form of a flat plate is disposed between the discharge roller pair 26 and the handling tray 4. The auxiliary tray 13 is smaller than the handling tray 4 in the dimension as measured in the direction of discharge of the recording sheets S, and in this particular embodiment, the former is smaller than the latter both in length and width. The auxiliary tray 13 is supported on the upstream side of the handling tray 4 to be movable back and forth between a projecting position where it is projected over the handling tray 4 and a retracted position where it is retracted from the handling tray 4. As shown in FIG. 5, each side edge portion of the auxiliary tray 13 is supported by upper and lower guide rollers 45 to be movable back and forth. A rack 46 is provided on a central portion of the auxiliary tray 13 and a pinion 47 is in mesh with the rack 46, which is driven by an auxiliary tray motor (not shown). The auxiliary tray 13 in the projected position is shown by the solid line in FIG. 2.

The auxiliary tray 13 is moved to the projecting position in order to separate a series of recording sheets S to be handled together from another series of recording sheets S.

The recording sheet S discharged onto the auxiliary tray 13 comes to be in light contact with the lower roller of the discharge roller pair 26 and the right edge (as seen in FIG. 2) of the recording sheet S is positioned on the right side of the discharge roller pair 26.

When the preceding sheet stack S' on the handling tray 4 is transferred toward the accumulation tray 9, the auxiliary tray 13 is retracted and the recording sheet S on the auxiliary tray 13 is dropped onto the handling tray 4.

The stapler 8 is for binding the sheet stack S' with a staple near an edge of the sheet stack S'. The stapler 8 is disposed beside the erected wall surface 4*a* on the side of the accumulation tray 9.

Stapling by the stapler 8 is effected by transferring the sheet stack S' by the first and second grippers 7 and 10. That is, when the sheet stack S' is to be stapled in one position (at a corner of the sheet stack S'), the first gripper 7 stops the sheet stack S' with a desired position of the sheet stack S' opposed to the stapler 8 and then the stapler 8 is operated. When the sheet stack S' is to be stapled in two positions, the first gripper 7 stops the sheet stack S' with a first position of the sheet stack S' opposed to the stapler 8 and then the stapler 8 is operated, and thereafter the first gripper 7 transfers the sheet stack S' to the second gripper 10 and the second gripper 10 stops the sheet stack S' with a second position of the sheet stack S' opposed to the stapler 8 and the stapler 8 is operated. The stapler 8 may be arranged to be movable along the direction A of discharge so that the stapling position can be changed according to the size of the staples.

The accumulation tray 9 is disposed spaced from the handling tray 4 in the direction B of transfer intersecting the direction A of discharge and is supported on the second housing 50. The accumulation tray 9 is inclined to be higher leftward in FIG 3. A recess 9*a* for facilitating taking out the sheet stacks S' on the accumulation tray 9 is formed in a side edge portion of the accumulation tray 9, as illustrated in FIG. 6.

Figure 6:
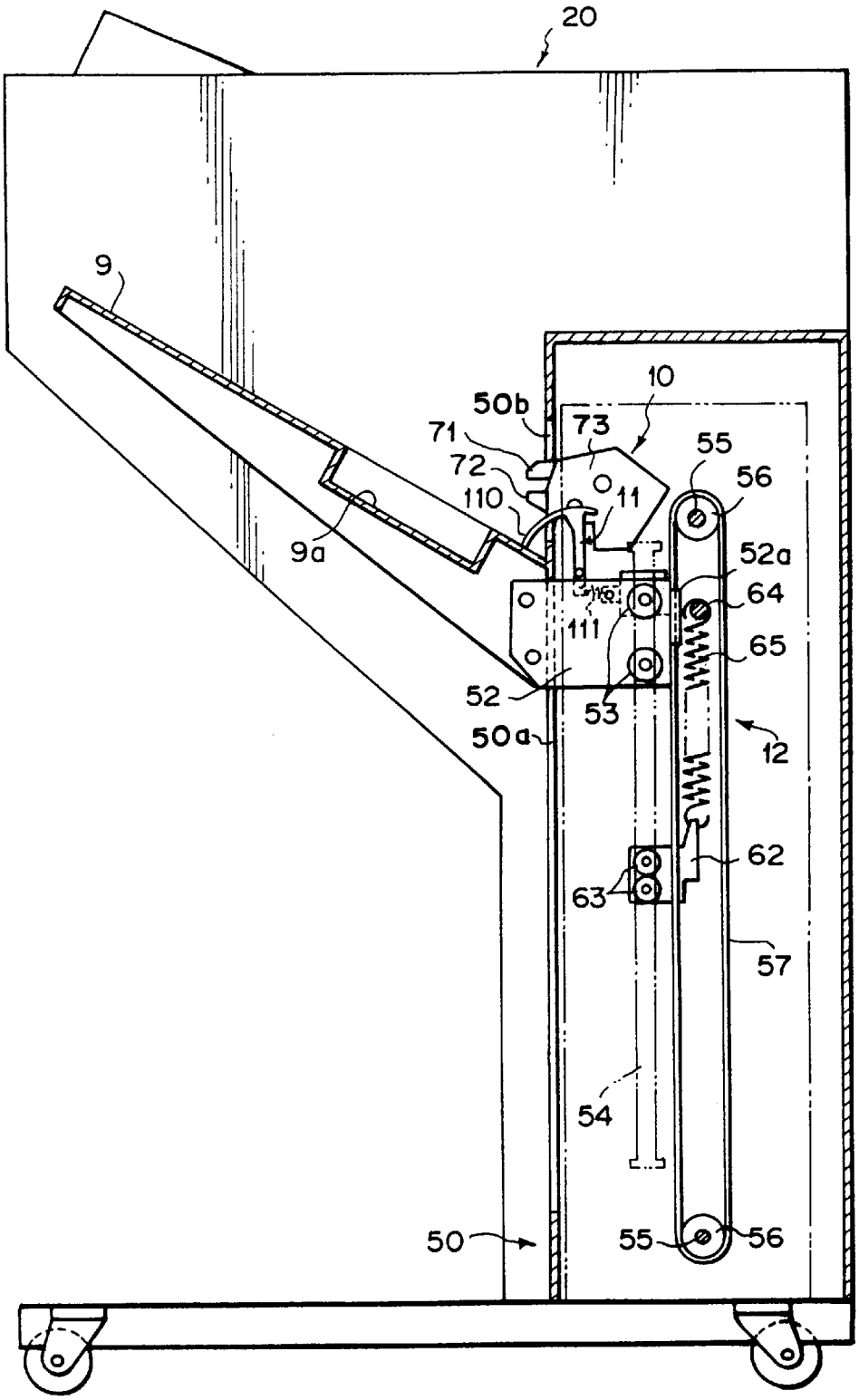
FIG. 6 is a cross-sectional view showing the accumulation handling apparatus employed in the system shown in FIG. 1.
Figure 7:
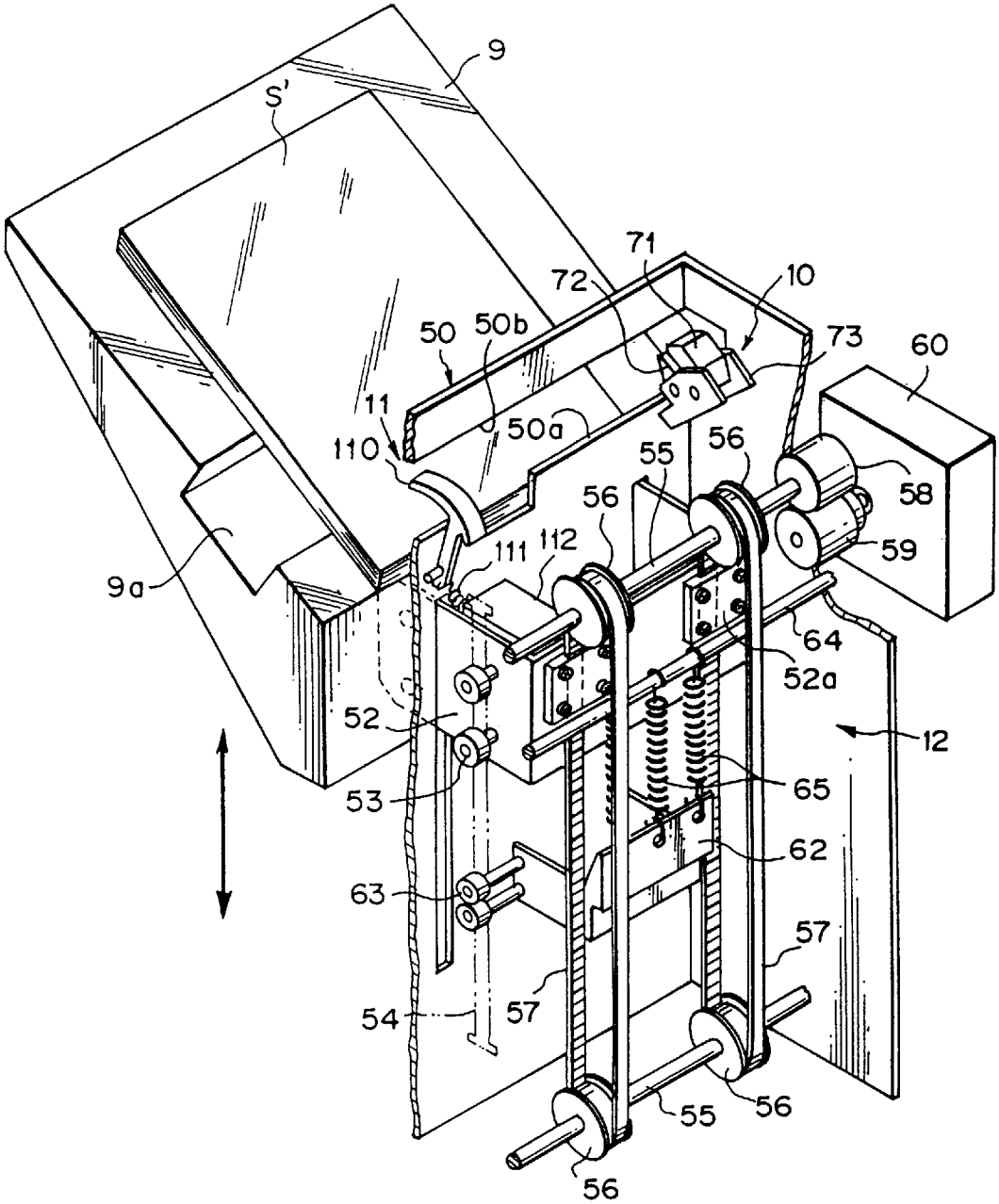
FIG. 7 is a perspective view partly cut away showing the structure of the accumulation handling apparatus.

As shown in FIGS. 6 and 7, the accumulation tray 9 is supported on the second housing 50 to be movable up and down. A vertical wall surface 50*a* of the second housing 50 functions as a reference surface for lining up the rear edges of the sheet stacks S'.

Figure 3:
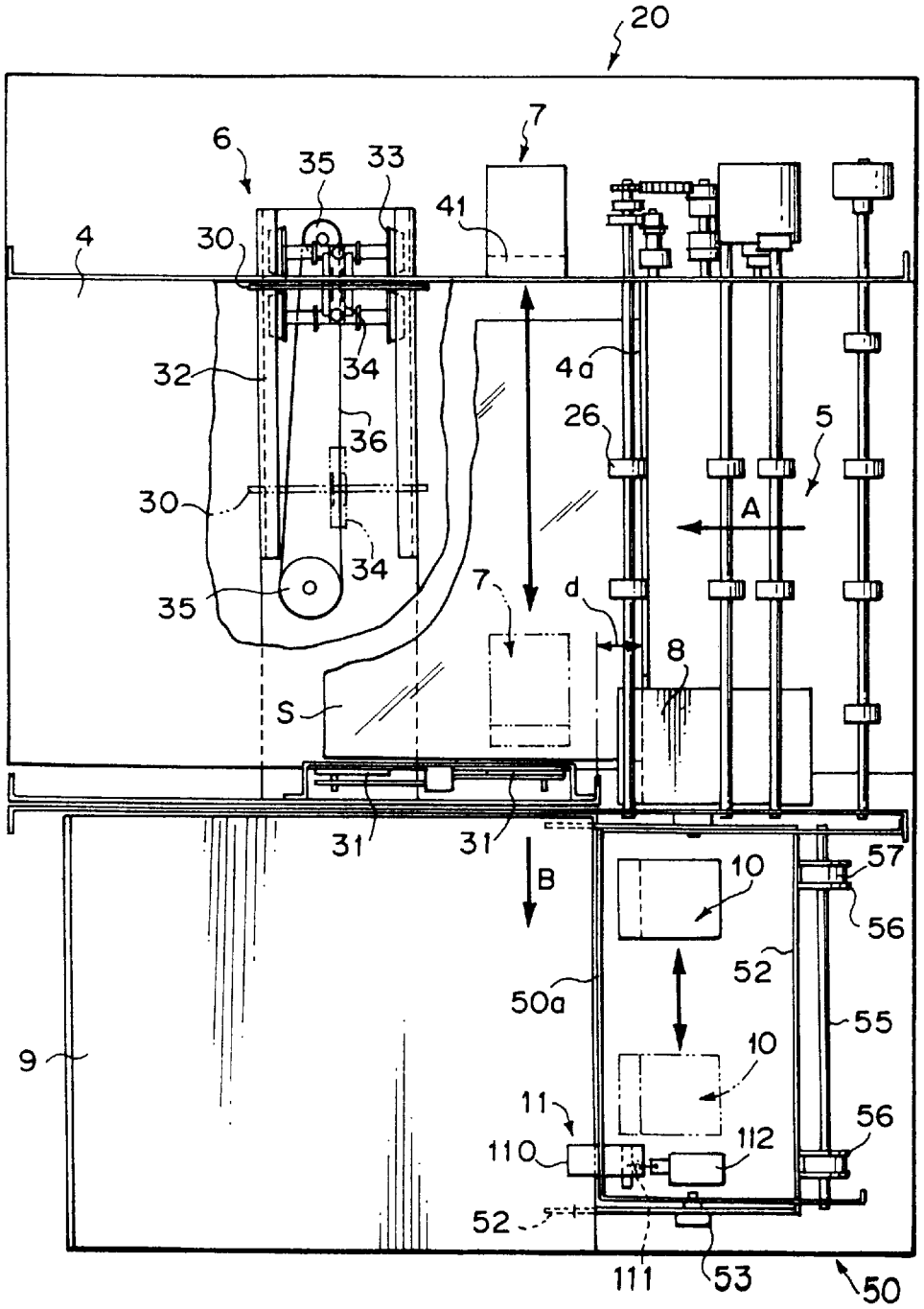
FIG. 3 is a plan view showing the sheet handling apparatus and the accumulation handling apparatus.

As shown in FIG. 3, the reference surface (the vertical wall surface 50*a*) of the accumulation tray 9 is shifted relative to the reference surface 4*a* of the handling tray 4 by a distance d in the direction A of discharge.

As shown in FIG. 7, the accumulation tray 9 is fixed to end portions of an up-and-down frame 52 projecting outward from the second housing 50 at the second housing side end portion thereof. The up-and-down frame 52 is provided with a pair of rollers 53 on each side thereof, and the rollers 53 are movable along vertical salts 54 formed in an inner wall of the housing.

Upper and lower shafts 55 extend horizontally along the end of the accumulation tray 9, and left and right pulleys 56 are fixed to each shaft 55. Belts 57 are passed respectively around the left upper and lower pulleys and the right upper and lower pulleys. A driven gear 58 is fixed to an end of the upper shaft 55 and is in mesh with a drive gear 59 fixed to the output shaft of an accumulation tray motor 60 so that the upper pulleys 56 are driven by the motor 60. The up-and-down frame 52 is fixed to the belts 57 by way of fasteners 52*a,* whereby the up-and-down frame 52 and the accumulation tray 9 are moved up and down when the belts 57 are run.

An auxiliary up-and-down frame 62 is supported for up-and-down movement along the vertical slots 54 by way of a pair of rollers 63 which are fixed to each side of the auxiliary up-and-down frame 62 and in engagement with each vertical slot 54. The auxiliary up-and-down frame 62 is suspended by a pair of springs 65 from a shaft 64 fixed above the auxiliary up-and-down frame 62. As the number of sheet stacks S' on the accumulation tray 9 increases and the accumulation tray 9 is moved downward, the lower end of the up-and-down frame 52 comes to abut against the auxiliary up-and-down frame 62. Thereafter the auxiliary up-and-down frame 62 is moved downward together with the up-and-down frame 52 overcoming the force of the springs 65. The springs 65 assists the accumulation tray motor 60 in supporting the weight of the sheet stacks S' on the accumulation tray 9, thereby preventing an excessive load from acting on the motor 60.

Figure 8:
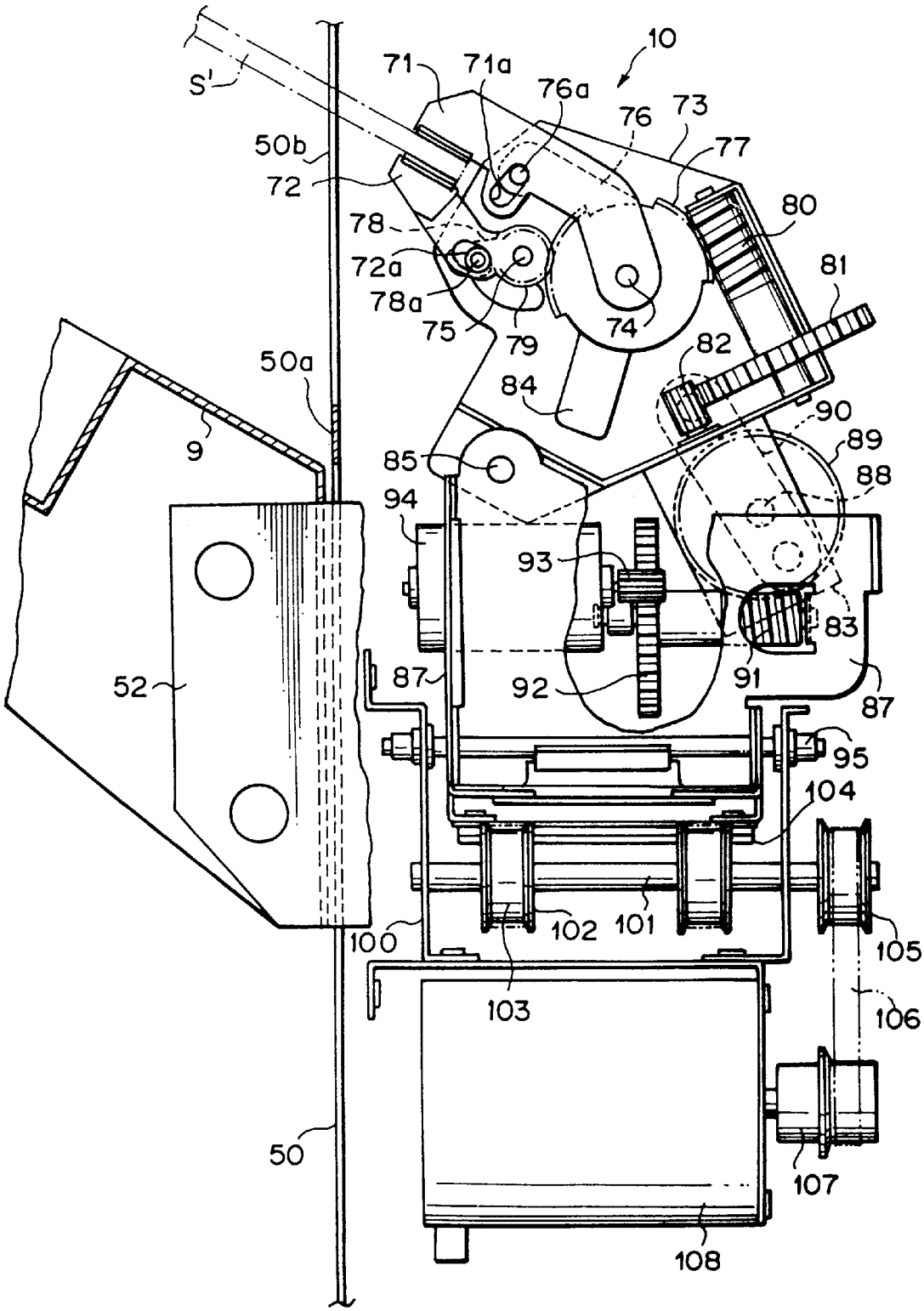
FIG. 8 is an enlarged fragmentary cross-sectional view showing an important part of the second gripper in its home position.
Figure 9:
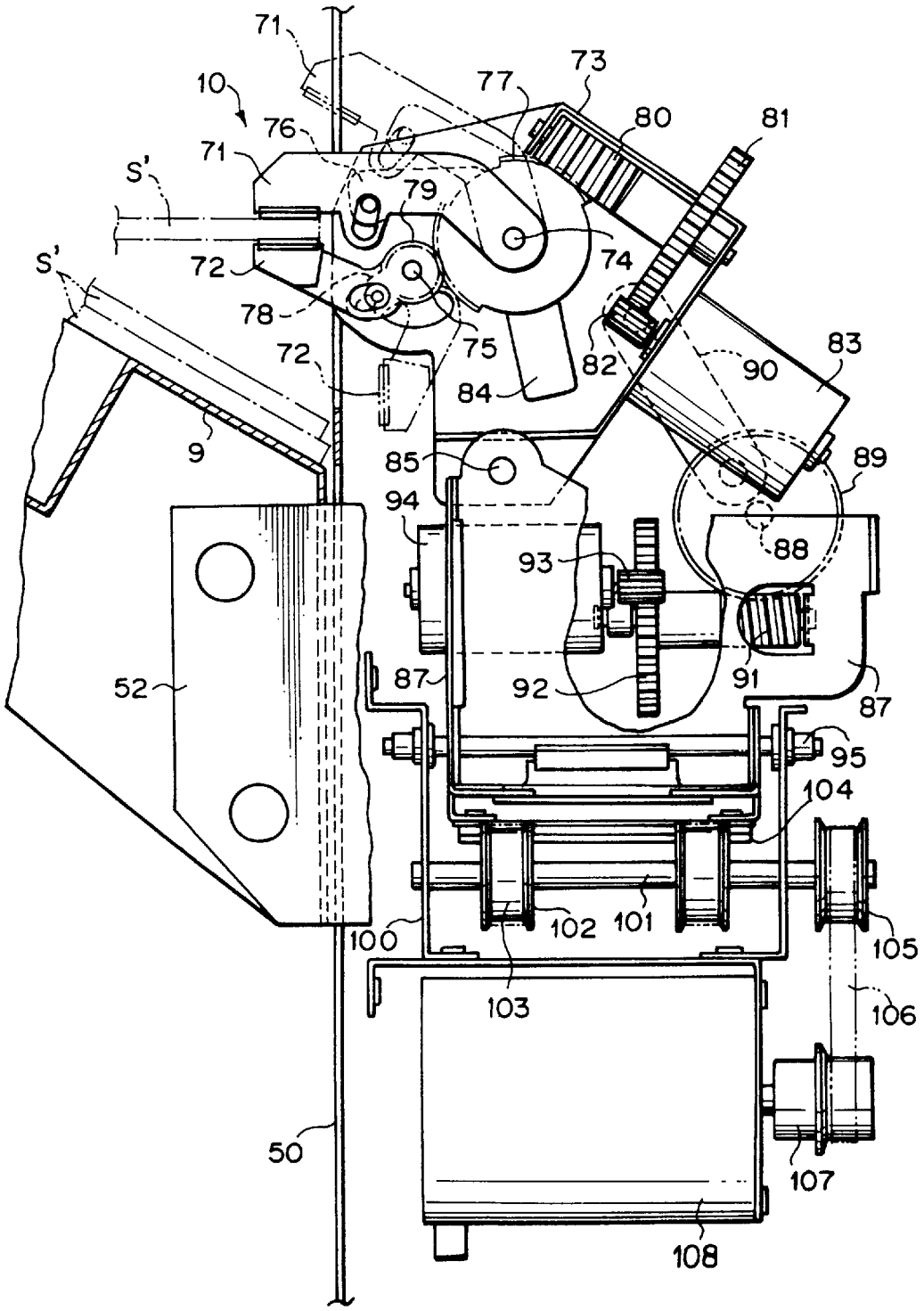
FIG. 9 is an enlarged fragmentary cross-sectional view showing the important part of the second gripper in its release position in a state where it is about to release the sheet stack.

As shown in FIGS. 8 and 9, the second gripper 10 receives the sheet stack S' which is gripped by the first gripper 7 and ejected from the handling tray 4 to the accumulation tray 9 while the first gripper 7 is transferring the sheet stack S' or the first gripper 7 is stopped. The second gripper 10 comprises upper and lower pinch levers 71 and 72 which respectively press the upper and lower surfaces of the sheet stack S' in surface contact therewith, thereby gripping therebetween the sheet stack S', an opening and closing mechanism which opens and closes the pinch levers 71 and 72 to release and grip the sheet stack S', and a transfer mechanism which transfers the pinch levers 71 and 72, and accordingly the sheet stack S', in the direction B. The pinch levers 71 and 72 grip the sheet stack S' in an inclined state and are rotated to rotate the sheet stack S' into a horizontal position and at the same time move the sheet stack S' toward the accumulation tray 9 by a small distance.

Specifically, the upper pinch lever 71 is supported for rotation on a rotating frame 73 at its base end portion by a first pivot pin 74 and the lower pinch lever 72 is supported for rotation on the rotating frame 73 by a second pivot pin 75. A first lever 76 having a partial gear 77 on its base portion is supported for rotation on the first pivot pin 74. A pin 76*a* projecting from the free end portion of the first lever 76 is received in an elongated hole 71*a* formed in the upper pinch lever 71. A second lever 78 is supported for rotation on the second pivot pin 75 and a pin 78*a* projecting from the free end of the second lever 78 is received in an elongated hole 72*a* formed in the lower pinch lever 72. A gear portion 79 is formed on the base portion of the second lever 78 and in mesh with the partial gear 77 of the first lever 76, whereby the upper and lower pinch levers 71 and 72 are opened and closed in response to rotation of the first and second levers 76 and 78.

The partial gear 77 of the first lever 76 is also in mesh with a pinion gear 80 supported on the rotating frame 73. An intermediate gear 81 which is rotated integrally with the pinion gear 80 is in mesh with a drive gear 82 of an opening and closing motor 83, which is mounted on the rotating frame 73. Thus the upper and lower pinch levers 71 and 72 are opened and closed driven by the motor 83. The state of opening or closing of the pinch levers 71 and 72 is detected by a sensor (not shown) which detects the position of an action piece 84 which is rotated integrally with the upper pinch lever 71.

The diameter of the partial gear 77 of the first lever 76 is larger than that of the gear portion 79 of the second lever 78 and accordingly the angle by which the upper pinch lever 71 is rotated upon opening the second gripper 10 differs from that of the second pinch lever 72. The upper pinch lever 71 is opened by about 30° whereas the lower pinch lever 72 is opened downward by about 90°. (FIG. 9)

The rotating frame 73 is supported for rotation on a movable frame 87 by a pivot pin 85 at its lower end portion. The movable frame 87 is provided with a shaft 88 extending in parallel to the pivot pin 85 and a rotating gear 89 is supported on the shaft 88. An off-centered position on the rotating gear 89 is connected to a rear end portion of the rotating frame 73 above the pivot pin 85 by a link 90 so that the rotating frame 73 is rotated between the retracted position shown in FIG. 8 and the projecting position shown in FIG. 9 by way of the link 90 in response to rotation of the rotating gear 89.

A pinion gear 91 which is supported for rotation to extend in perpendicular to the pivot pin 85 is in mesh with the rotating gear 89. An intermediate gear 92 which rotates integrally with the pinion gear 91 is in mesh with a drive gear 93 of the rotating motor 94, which mounted on the movable frame 87. Thus the rotating frame 73 is rotated driven by the rotating motor 94.

A pair of running members 95 which project on opposite sides of the movable frame 87 are engaged with guide grooves (not shown) formed on a guide frame 100 fixed to the second housing 50, whereby the movable frame 87 is supported to be movable in the direction of arrow B.

A pair of pulleys 102 (one of them is shown in FIGS. 8 and 9) are supported for rotation on pulley shafts 101 spaced from each other in the transverse direction of the second housing 50 inside the guide frame 100. A belt 103 is passed around the pulleys 102. The movable frame 87 is fixed to the belt 103 by a clamp 104. A driven pulley 105 is fixed to an end of one of the pulleys 102 and a drive belt 106 is passed around the driven pulley 105 and a drive pulley 107 fixed to the drive shaft of a transfer motor 108, which is a pulse motor and mounted on the lower surface of the guide frame 100.

In response to rotation of the transfer motor 108 in the regular direction or the reverse direction, the movable frame 87 and the second gripper 10 are moved back or forth in the direction of arrow B. The home position of the second gripper 10 is a sheet receiving position beside the handling tray 4. The second gripper 10 is moved forward from the home position to a release position, where it releases the sheet stack S', by way of an intermediate position, where the sheet stack S' gripped by the second gripper 10 is bound by the stapler 8 and moved back from the release position to the home position by way of the intermediate position. In the home position and the release position, the second gripper 10 is opened and closed and is rotated in the release position.

The transfer mechanism for transferring the second gripper 10, the opening and closing mechanism for opening and closing the second gripper 10 and the rotating mechanism for rotating the second gripper 10 are disposed inside the second housing 50 and the area over which the second gripper 10 is moved is covered with the housing. A horizontal slot 50*b* is formed in an upper portion of the second housing 50 and the second gripper 10 is moved along the slot 50*b* holding the sheet stack S'. In the release position, the upper and lower pinch levers 71 and 72 of the second gripper 10 are rotated and projected outside the second housing 50 toward the accumulation tray 9 through the slot 50*b*.

As shown in FIGS. 6 and 7, the sheet level detecting means 11 comprises a rotating sensor 110 which is provided with an arcuate end portion and is supported for rotation. The rotating sensor 110 is rotated by an actuator 112 by way of a spring 111. The leading end of the rotating sensor 110 is brought into contact with the upper surface of the sheet stack S' on the accumulation tray 9 and the level of the upper surface of the sheet stacks S' on the accumulation tray 9 is detected through the amount of rotation of the rotating sensor 110 by which the rotating sensor 110 is rotated before the leading end of the rotating sensor 110 is brought into contact with the upper surface of the sheet stack S'. The accumulation tray 9 is moved up and down according to the level of the upper surface of the sheet stack S' thus detected.

The mechanisms are controlled by a control unit (not shown) and the operator sets the number of sheets in one set, the number of sets, whether each set is to be stapled, the position of stapling and the like through a control panel of the control unit.

Figure 10:
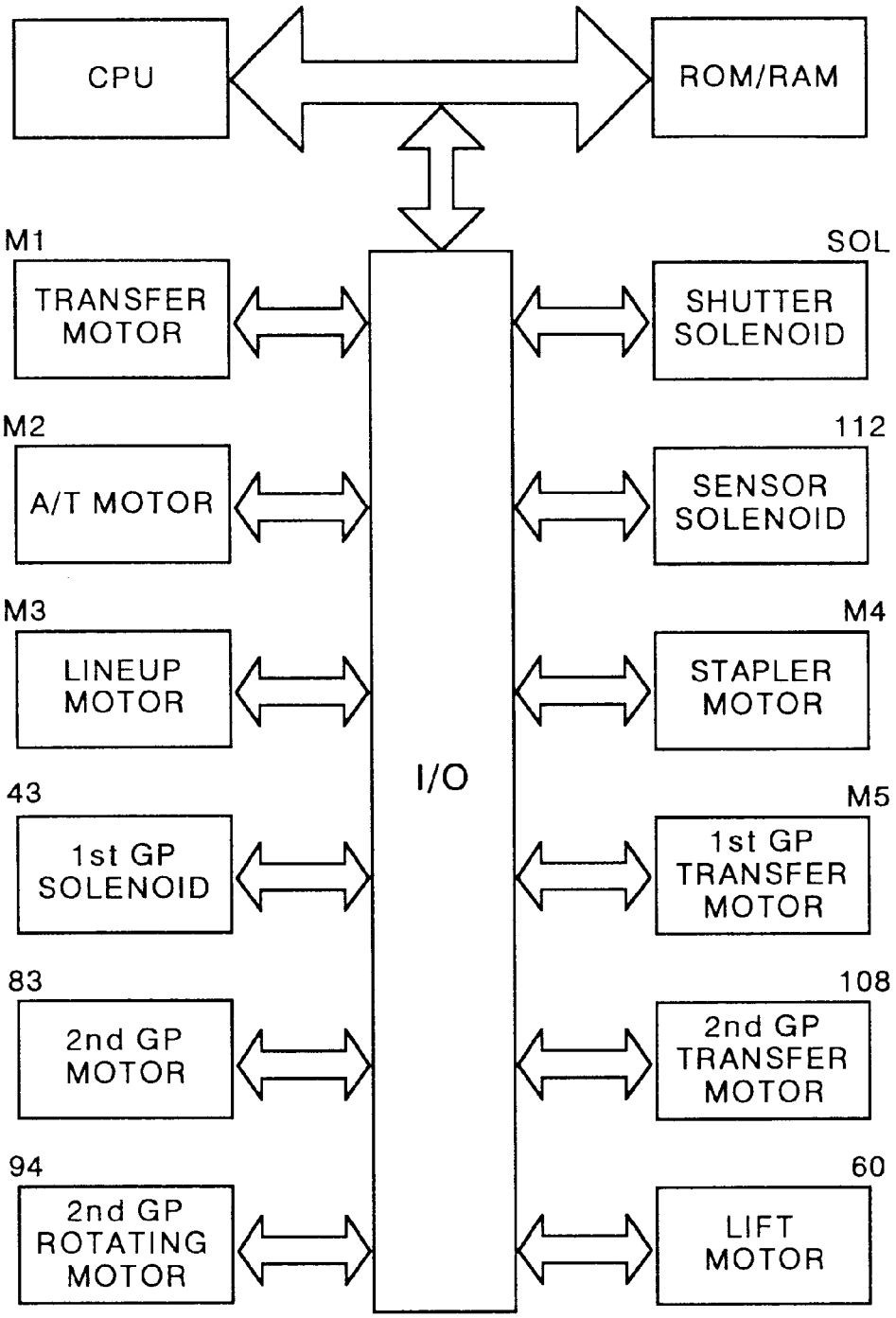
FIG. 10 is a block diagram showing the control system of the sheet handling system.

As shown in FIG. 10, the aforesaid drive systems are connected to a computer including a CPU, a ROM which stores program control signals and the like and a RAM which reads and right results of control and the like by way of a parallel I/O and are controlled according to the following program. In FIG. 10, M1 denotes a transfer motor for transferring the recording sheet S discharged from the image recording apparatus 2, M2 denotes an auxiliary tray motor for moving the auxiliary tray (A/T) 13, M3 denotes a lineup motor for driving the lineup member 30, M4 denotes a stapler motor for driving the stapler 8, M5 denotes a first gripper transfer motor for transferring the first gripper (1st GP) 7 and SOL denotes a shutter solenoid for moving upward the reference plate 31.

The handling step of the sheets S will be described with reference to FIGS. 11 to 13, hereinbelow. In the flow chart shown in FIGS. 11 and 12 and the timing chart shown in FIG. 13, each pair of sheets S (the same sizes) are stacked into a sheet stack S', and then the sheet stacks S' are stapled and stacked on the accumulation tray 9. In FIG. 13, Mi (i=1 to 19) represents the timing at which the corresponding part is operated or the period for which the corresponding part is operated.

Figure 11:
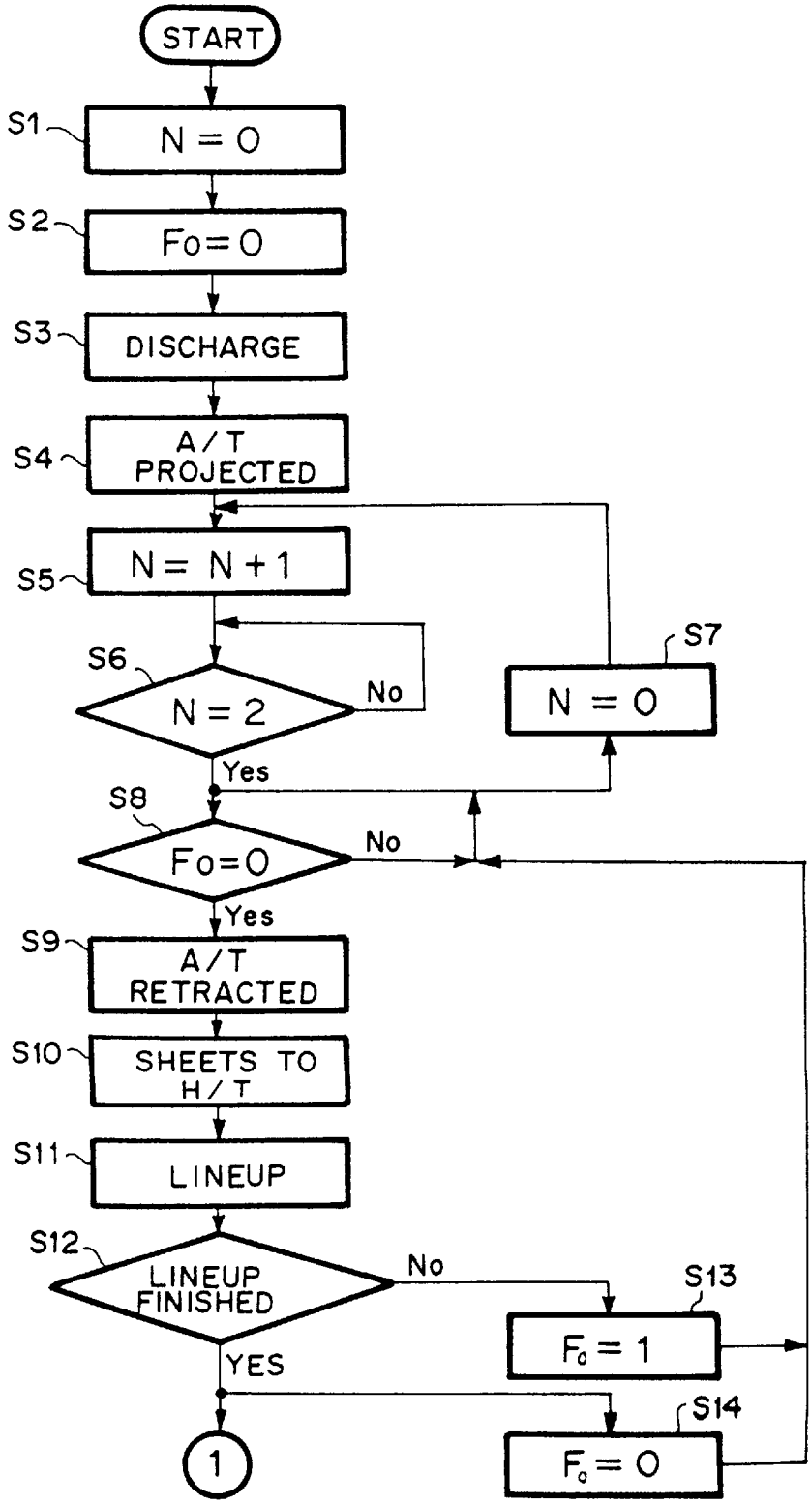
FIG. 11 is a flow chart for illustrating a first half of the operation of the sheet handling system.
Figure 12:
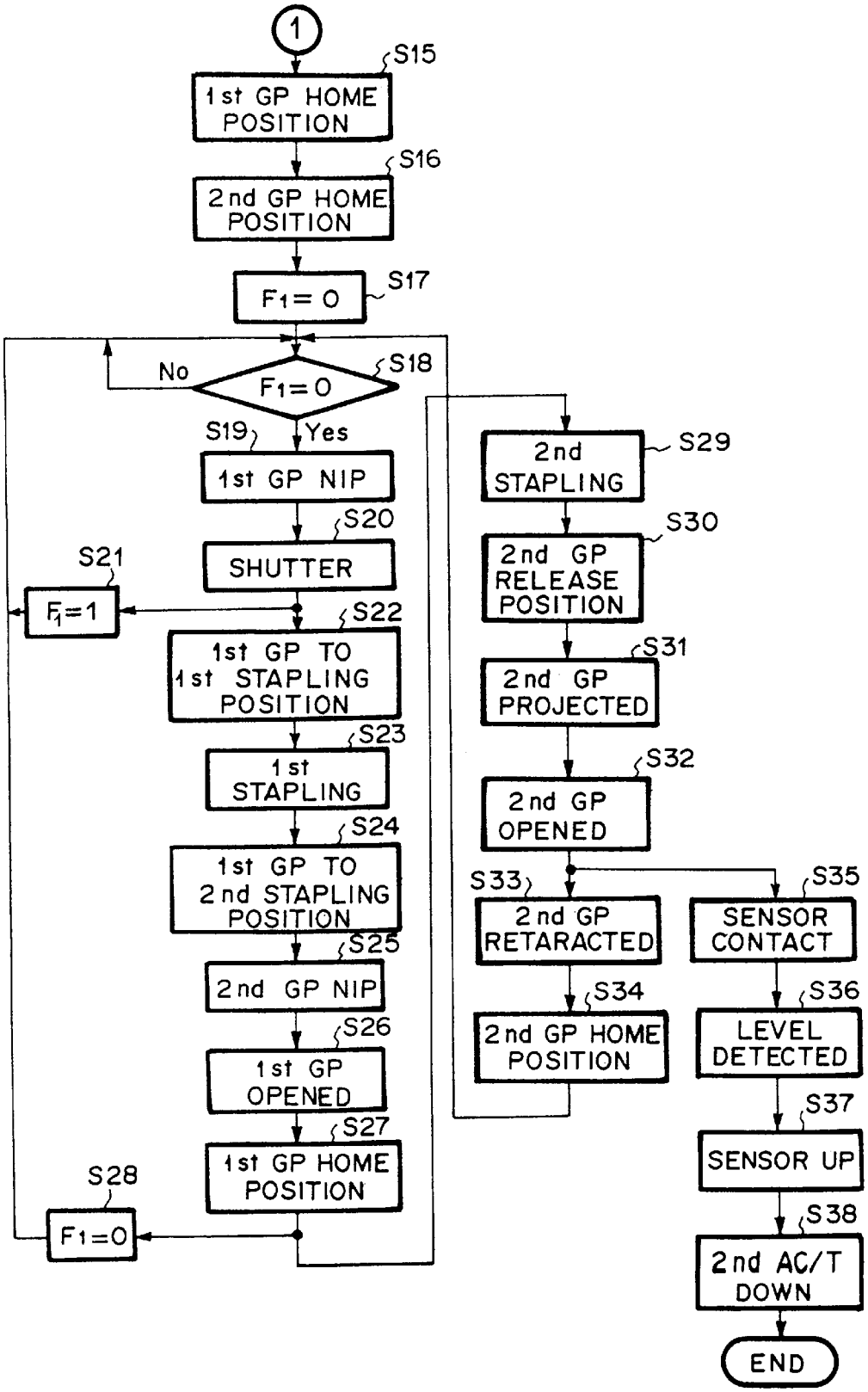
FIG. 12 is a flow chart for illustrating a second half of the operation of the sheet handling system.
Figure 13:
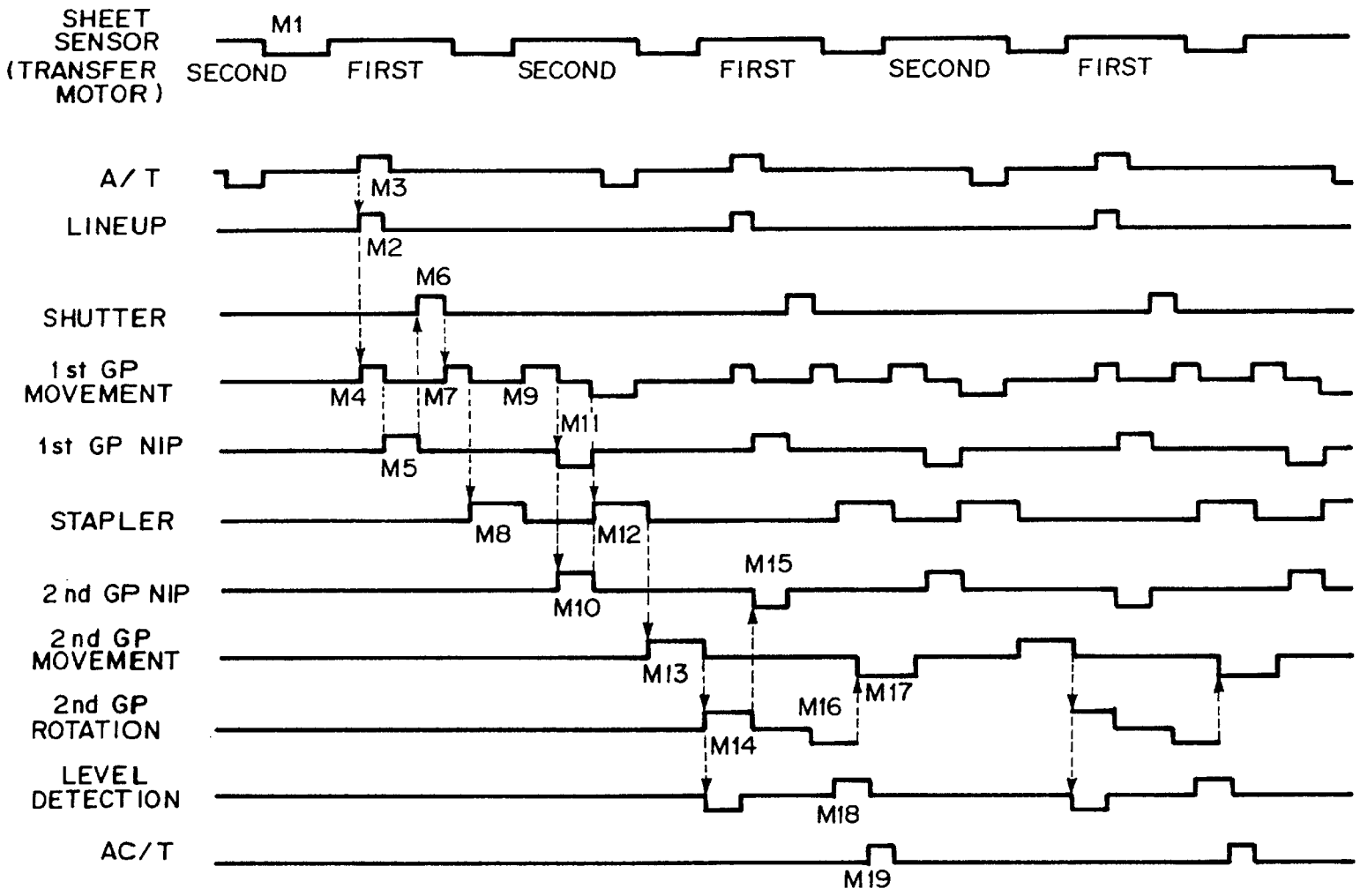
FIG. 13 is a timing chart for illustrating the operation of the sheet handling system.
Figure 14A:
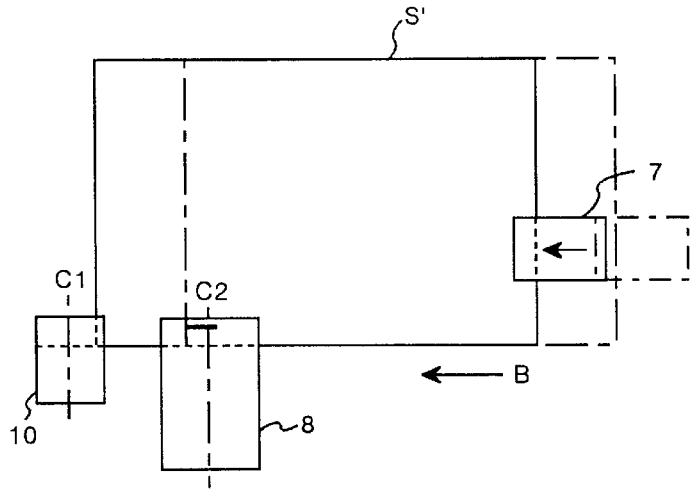
FIGS. 14A to 14C are schematic views for illustrating the movement of the first gripper and the sheet stack when delivering the sheet stack to the second gripper.
Figure 14B:
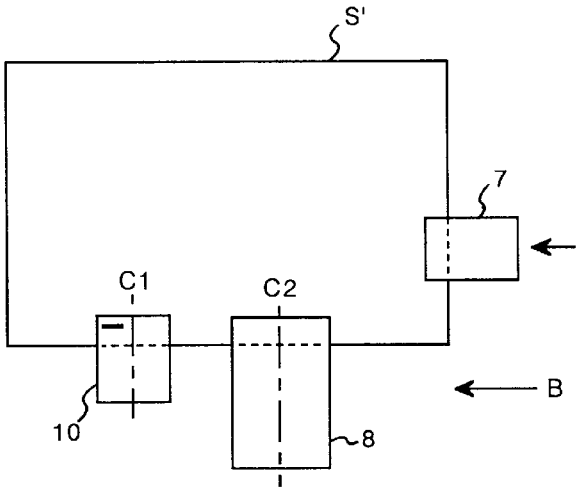
Figure 14C:
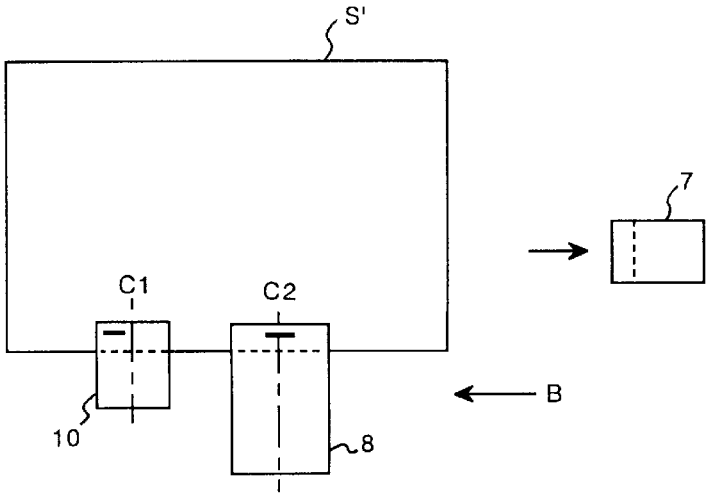

In the flow chart shown in FIGS. 11 and 12, the number N of the recording sheets which has been discharged from the image recording apparatus 2 is set to 0 and a sheet lineup flag Fo is set to 0 (representing that the preceding sheet stack has been lined up) as an initialization. (steps S1 and S2) The recording sheets S are discharged from the image recording apparatus 2 one by one. (step S3) At this time the auxiliary tray (A/T) 13 is projected and the sheets S are transferred onto the auxiliary tray 13, N is incremented one by one and a pair of sheets S are stacked on the auxiliary tray 13. (steps S4, S5 and S6) When a pair of sheets S are stacked on the auxiliary tray 13, N is reset to 0 and at the same time it is determined whether the sheet lineup flag Fo is 0. (steps S7 and S8) When it is determined that the sheet lineup flag Fo is 0, that is, the preceding sheets S have been lined up, the auxiliary tray 13 is retracted to permit the sheets S to fall onto the handling tray (H/T) 4. (steps S9 and S10) When the sheets S fall onto the handling tray 4, the sheets slide rearward by virtue of the inclination of the handling tray 4 and their rear edges are brought into abutment against the wall surface 4*a* of the handling tray 4, whereby the sheets S are lined up in the longitudinal direction. M1 in FIG. 13 represents operation of the sheet sensor and the transfer motor (not shown). Thereafter the lineup member 30 pushes one side edges of the sheets S to press the other edges of the sheets S against the reference plate 31, whereby lineup of the sheets S in the transverse direction is effected. (step S11, M2: lineup) The auxiliary tray 13 is projected (M3) when a next series of (pair of) sheets S are discharged while the preceding series of sheets S are in the lineup step (F0=1), thereby supporting the sheets S of the next series and separating the next series of sheets S from the preceding series of sheets S. (steps S11 to S14) FIGS. 14A to 14C show in sequence the movement of the first gripper and the sheet stack S' until the sheet stack S' is delivered to the second gripper 10 from the first gripper 7 during transfer of the sheet stack S' from the handling tray 4 (disposed on the left side of the FIGS. 14A to 14C) to the accumulation tray 9. During the procedure shown in FIGS. 14A to 14C, the second gripper 10 and the stapler 8 are kept stationary as shown by center lines C1 and C2.

After lineup is finished, the first gripper (1st GP) 7 is moved to its home position shown by the solid line in FIG. 3. (step S15, M4) At this time, the second gripper (2nd GP) 10 is in its home position shown by the solid line in FIG. 3. (step S16) Here a transfer flag F1 representing whether a sheet stack S' is being transferred is set to 0 (representing that a sheet stack S' is not being transferred). (step S17) Then the first gripper 7 is caused to nip the rear side edge portion of the sheet stack S' which has been lined up. (steps S18 and S19, M5, the chained line in FIG. 14A)

Then the reference plate (shutter) 31 is moved upward (step S20, M6) to permit the sheet stack S' to move in the direction B of transfer, transfer of another sheet stack S' is waited for (F1=1, step S21), the first gripper 7 is moved toward the accumulation tray 9 by a predetermined distance in the direction B of transfer, which intersects the direction A of discharge, to bring a first stapling position on the sheet stack S' to the stapler 8 (step S22, M7, the solid line in FIG. 14A). Then the stapler 8 is operated to bind the sheet stack S' in the first stapling position. (step S23, M8) The reference plate 31 is moved downward just after the sheet stack S' is inserted below the reference plate 31 and presses downward the sheet stack S' lightly to permit passage of the sheet stack S'.

Then the first gripper 7 is moved forward to bring a second stapling position on the sheet stack S' to the stapler 8 (step S24, M9, FIG. 14B, the solid line in FIG. 1). At this time, the second gripper (2nd GP) 10 is in its home position beside the handling tray 4 (the solid line in FIGS. 3 and 4) and in the retracted position shown in FIG. 8. When the first gripper 7 is stopped, the second gripper 10 nips the sheet stack S' at the side on the reference surface in the position. (step S25, M10)

After the second gripper 10 nips the sheet stack S', the first gripper 7 is opened to release the sheet stack S' (step S26, M11, FIG. 14C) and is moved to the home position shown by the solid line in FIG. 2 (step S27). Then the transfer flag F1 is reset to 0, thereby permitting transfer of another sheet stack S'. (step S28) Then the stapler 8 is operated to bind the sheet stack S' in the second stapling position. (step S29, M12) The stapling positions are set by the operator as the amounts of transfer by the first gripper 7.

Thereafter the second gripper 10 is moved to the release position shown by the chained line in FIGS. 3 and 4 and stopped there. (step S30, M13) In the release position, the second gripper 10 is rotated from the retracted position shown in FIG. 8 to the projecting position shown in FIG. 9, whereby the sheet stack S' held by the second gripper 10 comes to be held horizontally and is moved in a direction perpendicular to the direction B of transfer. (step S31, M14)

That is, the second gripper 10 transfers the sheet stack S' to the release position in such a manner that the rear edge (the edge facing the reference surface 4*a*) of the sheet stack S' is slid along the reference surface 4*a* of the handling tray 4 which is retracted from the reference surface 50*a* of the accumulation tray 9 as shown in FIG. 8. When the second gripper 10 is rotated to the projecting position shown in FIG. 9, the rear edge of the sheet stack S' comes to be substantially aligned with the reference surface 50*a* of the accumulation tray 9. By the rotation of the second gripper 10, the rear edge of the sheet stack S' is held horizontally. (M14) In the release position, the upper and lower pinch levers 71 and 72 of the second gripper 10 are opened as shown by the chained line in FIG. 9 and the sheet stack S' is caused to fall on the accumulation tray 9 or the preceding sheet stacks S'. (step S32, M15)

The sheet stack S' dropped from the second gripper 10 is stacked on the preceding sheet stack S' on the accumulation tray 9 without the rear edge thereof being largely shifted from the rear edge of the preceding sheet stacks S' and without the rear edge thereof being engaged with the staple on the preceding sheet stack S'

With the second gripper 10 held open, the rotating frame 73 is rotated back to return the second gripper 10 to the retracted position (step S33, M16), and the second gripper 10 is moved back to the home position (step S34, M17) At this time, even if another sheet stack S' is being transferred, the sheet stack S' does not interfere with the second gripper 10 since the upper and lower pinch levers 71 and 72 of the second gripper 10 are held open. Thus the second gripper 10 is returned to the home position and waits for gripping of another sheet stack S'.

In response to rotation of the second gripper 10 to the horizontal position (M14), the actuator (sensor solenoid) 112 of the sheet level detecting means 11 rotates the rotating sensor 110 to bring it into contact with the upper surface of the sheet stack S' on the accumulation tray (2nd AC/T) 9 (step S35) and the level of the sheet stacks S' on the accumulation tray 9 is detected (step S36, M18). Thereafter the actuator 112 rotates the rotating sensor 110 upward away from the sheet stack S'. (step S37, M19) When the sheet level is higher than a predetermined level, the accumulation tray 9 is lowered to the predetermined level by the lift means 12. (step S38, M20) When the sheet stack S' on the accumulation tray 9 is removed therefrom by the operator, the accumulation tray 9 is moved upward in response to detection thereof.

Since the second gripper 10 is moved inside the housing when it transfers the sheet stack S', the second gripper 10 and its transfer mechanism cannot interfere with the operator who is removing the sheet stacks S' on the accumulation tray 9. Further since the sheet stack S' is transferred while gripped by the second gripper 10, the sheet stack S' is kept lined up during transfer.

Though in the embodiment described above each of the first and second grippers 7 and 10 comprises a pair of pinch levers which presses the sheet stack S' in surface contact therewith, each gripper may comprise other members such as rollers. The drive mechanisms or the actuators for the respective parts may be variously modified.

When the rear edge of the accumulation tray 9 is shifted forward from the rear edge of the handling tray 4, the second gripper 10 and its transfer mechanism can be enclosed in the housing during transfer of the sheet stack S', which ensures safety.

In order to prevent formation of a bulge between the first and second stapling positions, it is preferred that the sheet stack S' which has been stapled in the first stapling position be pressed flat between the first and second stapling positions inclusive of the first stapling position. The second gripper 10 may double as a means for this purpose.

Figure 15A:
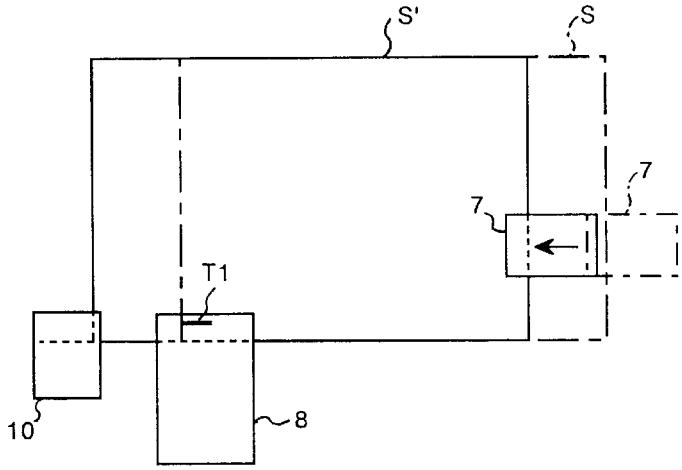
FIGS. 15A to 15C are schematic views similar to FIGS. 14A to 14C for illustrating a preferred manner of stapling the sheet stack S'.
Figure 15B:
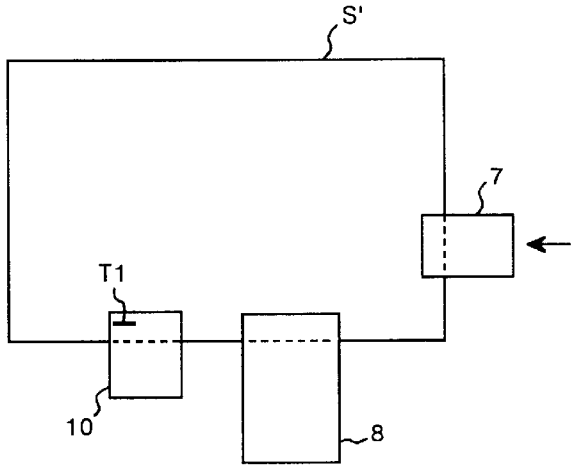
Figure 15C:
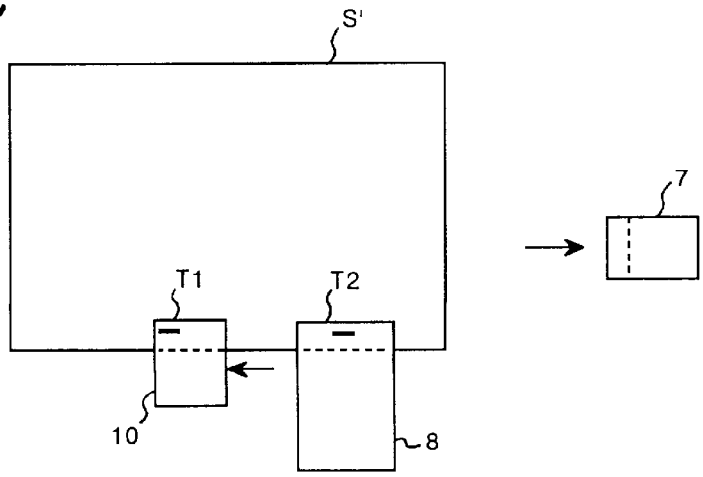

That is, as shown in FIG. 15A, the first gripper 7 transfers the sheet stack S' to bring the first stapling position T1 of the sheet stack S' to the stapler 8 and then the stapler 8 is operated to staple the sheet stack S' in the first stapling position T1. Then the first gripper 7 further transfers the sheet stack S' to bring the first stapling position T1 to the second gripper 10 and the second gripper 10 grips the sheet stack S' at a portion between the first and second stapling positions T1 and T2 including the first stapling position T1 as shown in FIG. 15B. After the second gripper 10 grips the sheet stack S', the first gripper 7 releases the sheet stack S'. Thereafter the second gripper 10 transfers the sheet stack S' to bring the second stapling position T2 to the stapler 8 and the stapler 8 is operated to staple the sheet stack S' in the second stapling position T2 as shown in FIG. 15C. Thereafter the second gripper 10 transfers the stapled sheet stack S' toward the accumulation tray 9 in the same manner described above.

In this example, since the second gripper 10 grips the sheet stack S' together with the stapler in the first stapling position, the second gripper 10 can properly grip the sheet stack S' even if the sheet stack S' is supported from below, and at the same time, since the portion between the first and second stapling positions T1 and T2 is pressed flat by the second gripper 10 and the rear end portion (as seen in the direction B of transfer) is released when the stapler 8 staples the sheet stack S' in the second position T2, no bulge can be formed between the first and second stapling positions T1 and T2.

Figure 16:
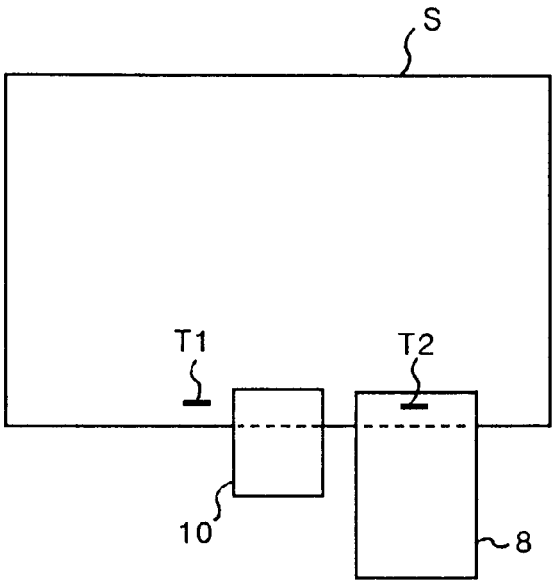
FIG. 16 is a schematic view for illustrating a modification of the manner shown in FIGS. 15A to 15C.

As shown in FIG. 16, the second gripper 10 may grip the sheet stack S' at a portion between the first and second stapling positions T1 and T2. In this case, it is preferred that the sheet stack S' be supported from below by a suitable means such as a tray when the second gripper 10 grips the sheet stack S'.

Figure 17:
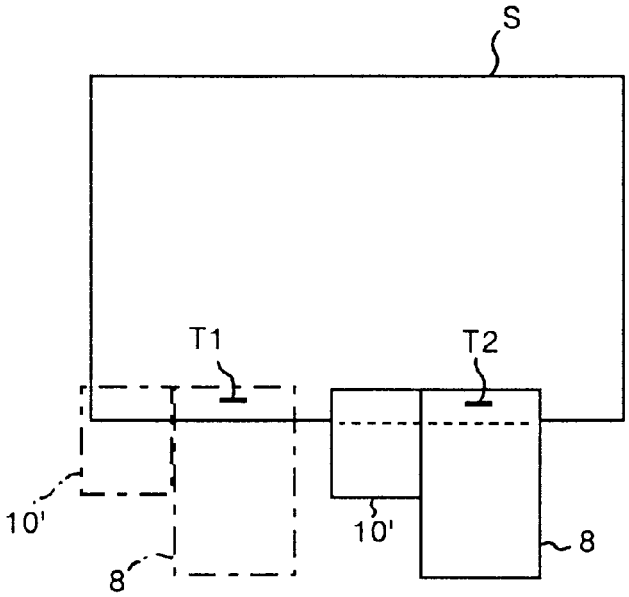
FIG. 17 is a schematic view for illustrating another modification of the manner shown in FIGS. 15A to 15C, FIGS. 18 and 19 show a flow chart for illustrating the operation of the sheet handling system in accordance with another embodiment of the present invention.

Otherwise a stationary pressing means 10' which presses the upper and lower surfaces of the sheet stack S' at a portion between the first and second stapling positions T1 and T2 may be provided as shown in FIG. 17.

Another embodiment of the present invention where the sheet stack S' is stapled at one corner and the stapled sheet stacks S' are stacked on the accumulation tray 9 in a staggered fashion each offset from the upper and lower sheet stacks S' so that the staples on the adjacent sheet stacks S' are not superposed one on another will be described hereinbelow.

Figure 18:
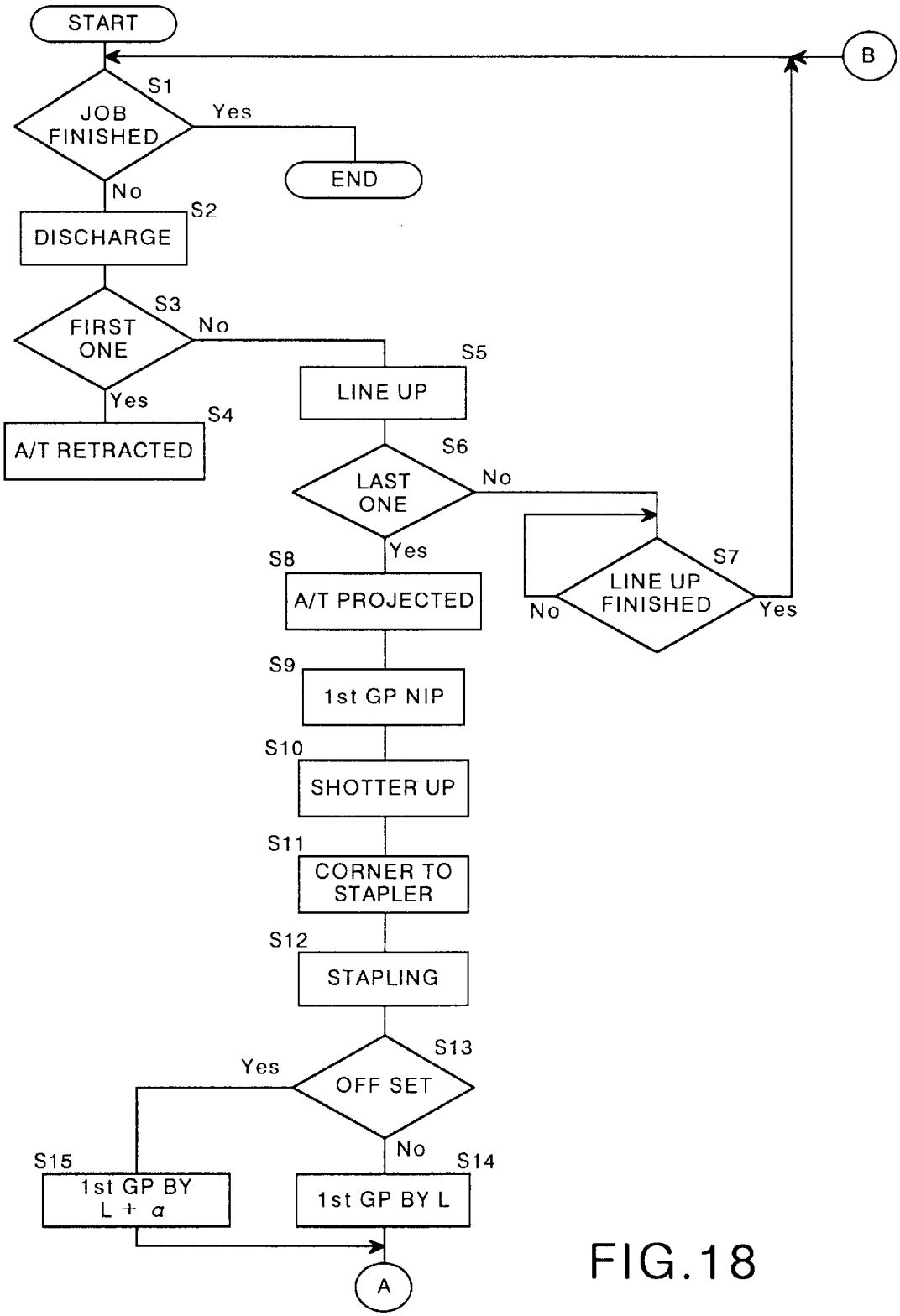
Figure 19:
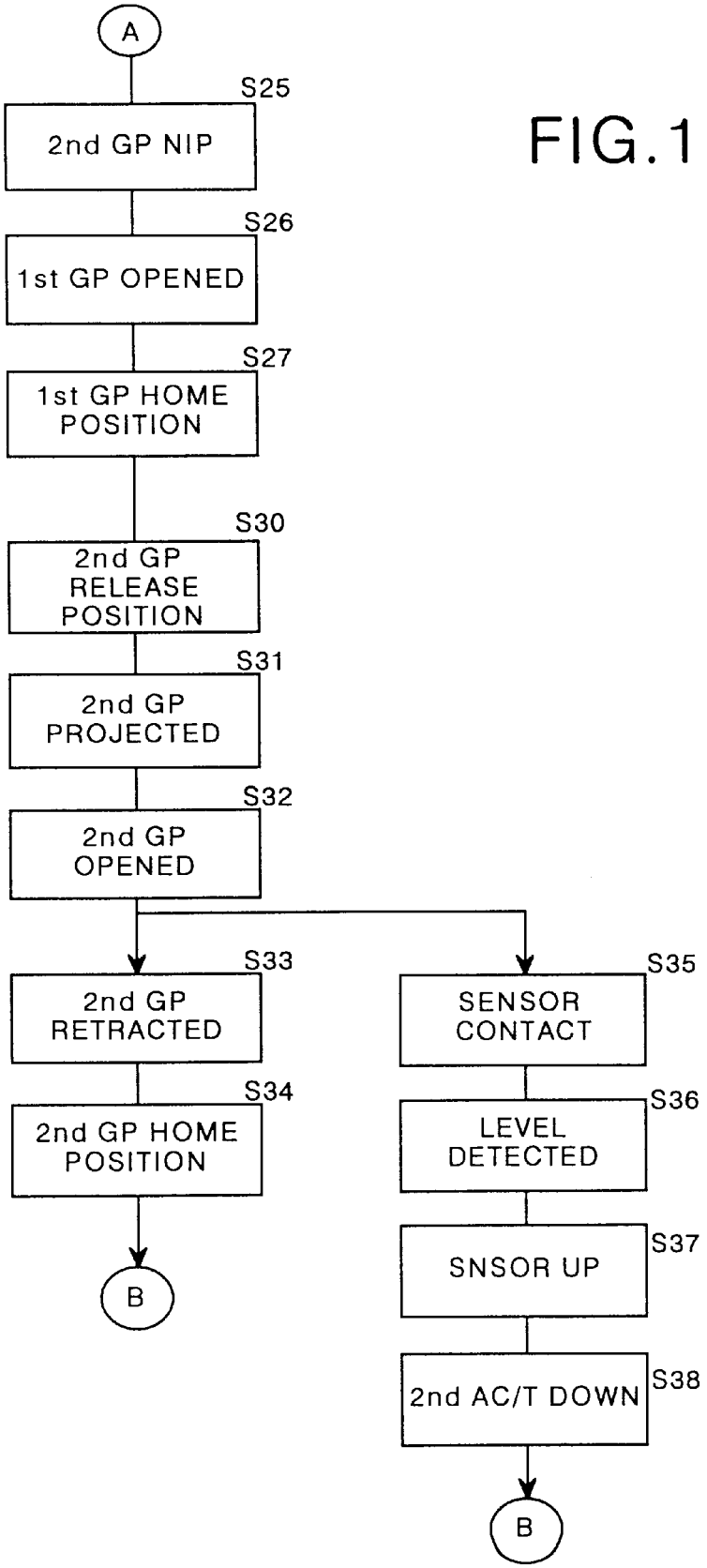
Figure 20:
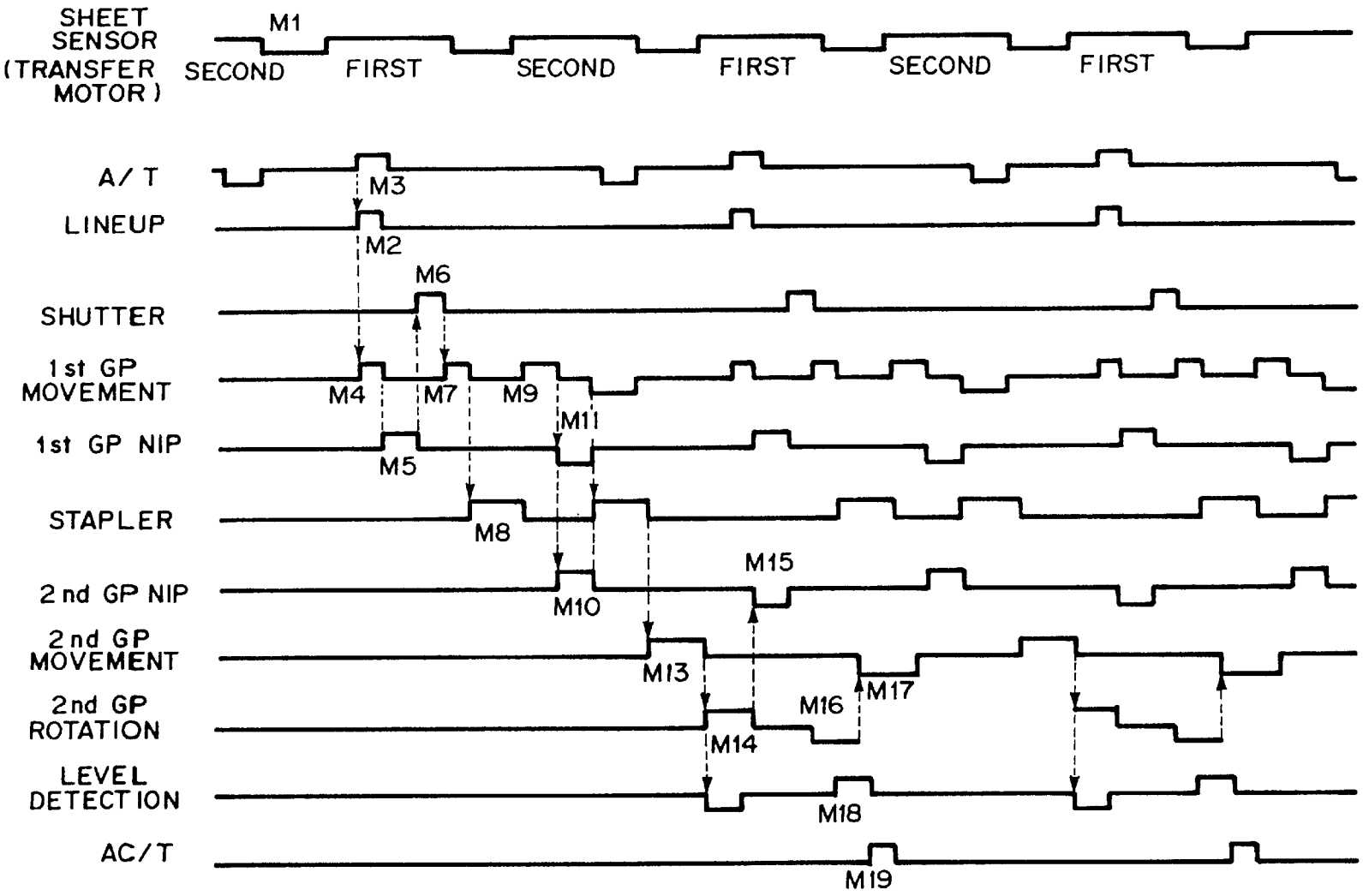
FIG. 20 is a timing chart for illustrating the operation of the sheet handling system.

In the flow chart shown in FIGS. 18 and 19 and the timing chart shown in FIG. 20, when the job is started, the recording sheets S are discharged from the image recording apparatus 2 one by one. (steps S1 and S2) When a first sheet of a series of recording sheets S is discharged, the auxiliary tray 13 is retracted and the first recording sheet S is fallen onto the handling tray 4. (step S4) When the first sheet S falls onto the handling tray 4, the sheets slide rearward by virtue of the inclination of the handling tray 4 and its rear edge is brought into abutment against the reference surface 4*a* of the handling tray 4, whereby the sheet S is lined up in the longitudinal direction. (M1 in FIG. 13 represents operation of the sheet sensor and the transfer motor not shown). From the second recording sheet on, the lineup member 30 pushes one side edge of each sheet S to press the other edge of the sheet S against the reference plate 31, whereby lineup of the sheets S in the transverse direction is effected. (step S5, M2: lineup) When the sheet S just discharged is not the last one in the series of sheets (step S6), whether lineup has been finished is checked (step S7). When the sheet S just discharged is the last one in the series of sheets, the auxiliary tray 13 is projected (step S8, M3) to support thereon a sheets S of the next series, thereby separating the next series of sheets S from the preceding series of sheets S.

After lineup is finished, the first gripper 7 is caused to nip the rear side edge portion of the sheet stack S' which has been lined up. (step S9, M5)

Then the reference plate (shutter) 31 is moved upward (step S10, M6), and the first gripper 7 is moved toward the accumulation tray 9 to bring a corner to be stapled of the sheet stack S' to the stapler 8 (step S11, M7). Then the stapler 8 is operated to bind the sheet stack S' at the corner. (step S12, M8) The reference plate 31 is moved downward just after the sheet stack S' is inserted below the reference plate 31 and presses downward the sheet stack S' lightly to permit passage of the sheet stack S'.

Then it is determined whether the sheet stack S' is to be stacked in an offset state, i.e., whether the sheet stack S' is an even number stack. (step S13) When it is determined that the sheet stack S' is not to be stacked in an offset state, the first gripper 7 is moved forward by a distance L (FIG. 21) (step S14, M11) and then delivers the sheet stack S' to the second gripper 10. At this time, the second gripper 10 is in its home position beside the handling tray 4 and in the retracted position shown in FIG. 8. When the first gripper 7 is stopped, the second gripper 10 nips the sheet stack S' at the side on the reference surface in the position. (step S25, M10) On the other hand, when it is determined in step S13 that the sheet stack S' is to be stacked in an offset state, the first gripper 7 is moved forward by a distance L+α (FIG. 212 (step S15) and then delivers the sheet stack S' to the second gripper 10. The steps from S25 on are substantially the same as the steps from S25 on of the preceding embodiment and will not be described here.

Figure 21A:
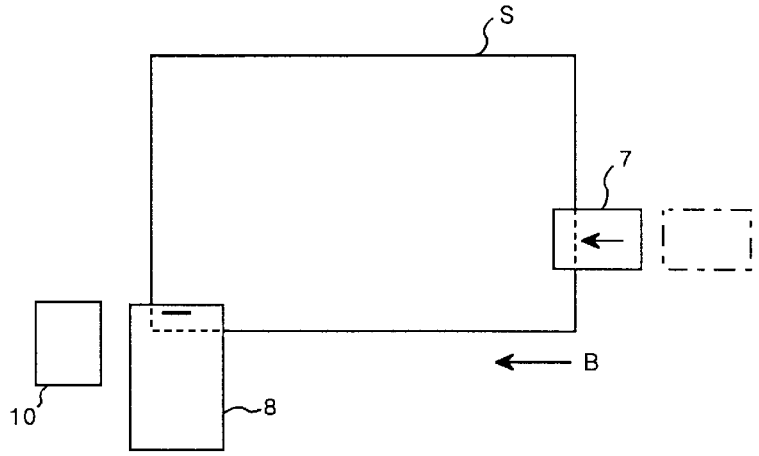
FIGS. 21A to 21C show in sequence the movement of the first gripper and the sheet stack until an odd number-the sheet stack S' is delivered to the second gripper from the first gripper during transfer of the sheet stack S' from the handling tray to the accumulation tray 9.
Figure 21B:
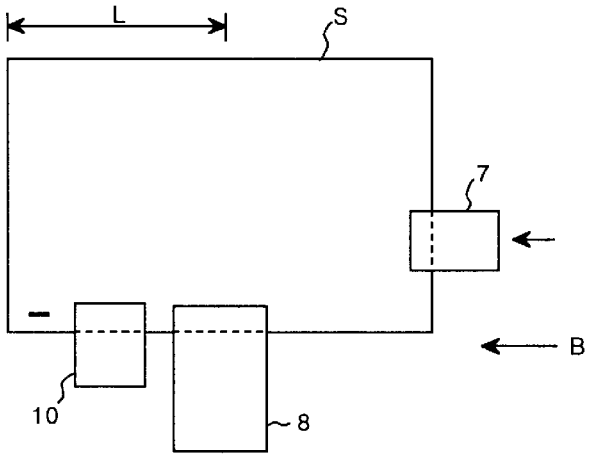
Figure 21C:
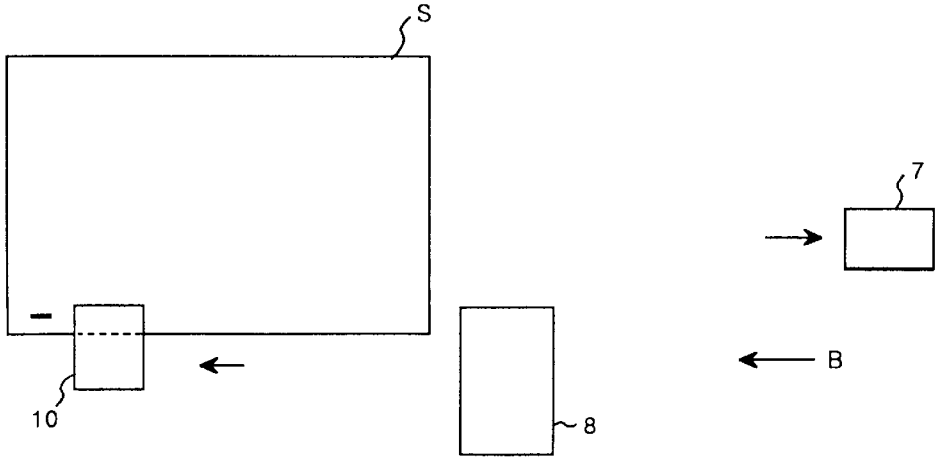
Figure 22A:
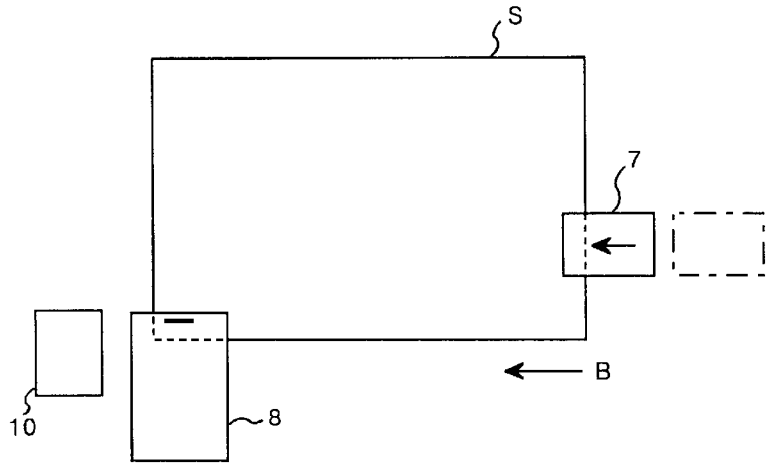
FIGS. 22A to 22C show the same until an even number-th sheet stack is delivered to the second gripper from the first gripper.
Figure 22B:
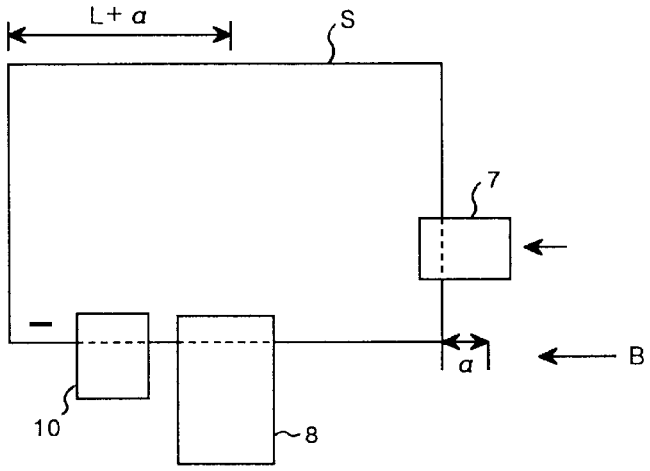
Figure 22C:
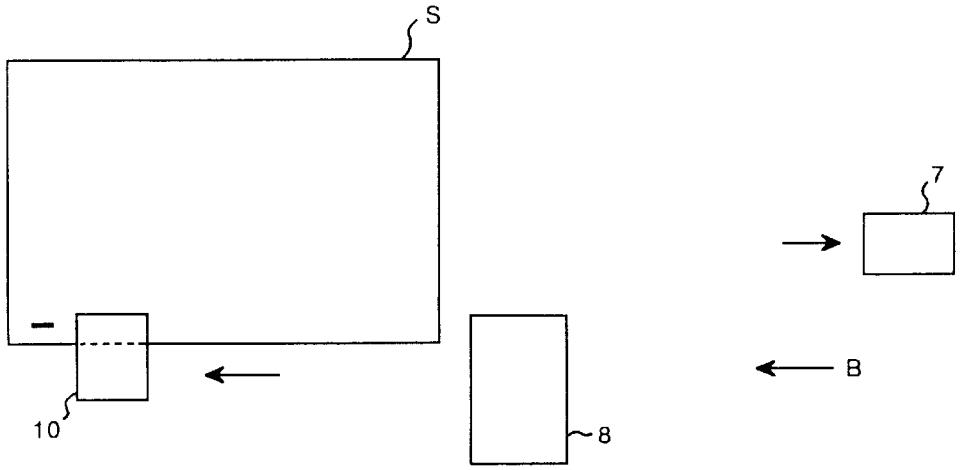

FIGS. 21A to 21C show in sequence the movement of the first gripper 7 and the sheet stack S' until an odd numbered sheet stack S' is delivered to the second gripper 10 from the first gripper 7 during transfer of the sheet stack S' from the handling tray 4 (disposed on the left side of the FIGS. 21A to 21C) to the accumulation tray 9, and FIGS. 22A to 22C show the same until an even numbered sheet stack S' is delivered to the second gripper 10 from the first gripper 7.

Figure 23:
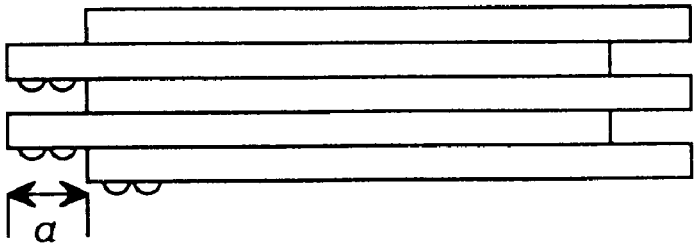
FIG. 23 is a side view showing the sheet stacks stacked in a staggered fashion.

Thus the second gripper 10 grips odd numbered sheet stacks at a portion at a distance L from the leading side edge of the sheet stack S' and even numbered sheet stacks at a portion at a distance L+α from the leading side edge of the sheet stacks. Accordingly each even numbered sheet stack is stacked on an odd numbered sheet stack in a state offset therefrom in the direction B of transfer by the distance a as shown in FIG. 23, whereby the staples on the sheet stacks are not superposed one on another.

Instead of changing the portion at which the second gripper 10 grips the sheet stack S', that is, the distance by which the sheet stack S' is transferred before delivered to the second gripper 10, the distance by which the sheet stack S' is transferred after received by the second gripper 10 may be changed. Otherwise both the distance by which the sheet stack S' is transferred before delivered to the second gripper 10 and the distance by which the sheet stack S' is transferred after received by the second gripper 10 may be changed.

When it is not necessary to staple the sheet stack, the stapling (step S12) may be omitted.

What is claimed is:

1. A sheet handling apparatus which receives on a handling tray a plurality of sheets discharged from an image recording apparatus in a first direction, thereby forming a sheet stack of a series of sheets on the handling tray, and transfers the sheet stack onto an accumulation tray which is disposed with respect to the handling tray in a second direction which intersects the first direction, said sheet handling apparatus comprising:

a first transfer means which transfers the sheet stack on the handling tray toward the accumulation tray in the second direction, and a second transfer means in the form of a gripper which grips the sheet stack at an edge portion on the image recording apparatus side, receives the sheet stack from the first transfer means after the first transfer means transfers the sheet stack by a predetermined distance in the second direction and transfers the sheet stack.

2. A sheet handling apparatus as defined in claim 1 in which said first transfer means is in the form of a gripper which grips the sheet stack at an upstream side edge portion as seen in the second direction.

3. A sheet handling apparatus as defined in claim 2 further comprising a first control means which controls transfer action of the first transfer means, a second control means which controls transfer action of the second transfer means, and a timing setting means which variably sets the timing at which the sheet stack is delivered from the first transfer means to the second transfer means.

4. A sheet handling apparatus as defined in claim 3 in which the first control means sets the delivery position of the first transfer means where it delivers the sheet stack to the second transfer means by variably setting the distance by which the first transfer means transfers the sheet stack by the timing set by the timing setting means and the second control means keeps fixed the receiving position of the second transfer means where it receives the sheet stack.

5. A sheet handling apparatus as defined in claim 3 in which the second control means variably sets the distance by which the second transfer means transfers the sheet stack from the receiving position where it receive the sheet stack at the timing set by the timing setting means to the release position where it releases the sheet stack onto the accumulation tray and the first control means keeps fixed the delivery position of the first transfer means where it delivers the sheet stack to the second transfer means.

6. A sheet handling apparatus as defined in claim 3 in which the first control means variably sets the distance by which the first transfer means transfers the sheet stack from the handling tray to the delivery position where it delivers the sheet stack to the second transfer means and the second control means variably sets the distance by which the second transfer means transfers the sheet stack form the receiving position where it receives the sheet stack to the release position where it releases the sheet stack on the accumulation tray.

7. A sheet handling apparatus as defined in claim 3 in which the accumulation tray is provided with a mechanism for moving the accumulation tray up and down.

8. A sheet handling apparatus as defined in claim 3 in which the second transfer means transfers the sheet stack in the second direction.

9. A sheet handling apparatus which receives on a handling tray a plurality of sheets discharged from an image recording apparatus in a first direction, thereby forming a sheet stack of a series of sheets on the handling tray and transfers the sheet stack onto an accumulation tray which is disposed with respect to the handling tray in a second direction which intersects the first direction, said sheet handling apparatus comprising:

a first transfer means which transfers the sheet stack on the handling tray toward the accumulation tray in the second direction, and a second transfer means in the form of a gripper which grips the sheet stack at an edge portion on the image recording apparatus side, receives the sheet stack from the first transfer means after the first transfer means transfers the sheet stack by a predetermined distance in the second direction and transfers the sheet stack, the second transfer means is moved along a path which is disposed outside of the accumulation tray on the side of a reference surface of the accumulation tray when transferring the sheet stack, the reference surface being a surface which is positioned on the image recording apparatus side of the accumulation tray and against which the sheet stacks are brought into abutment to line up the sheet stacks.

10. A sheet handling apparatus as defined in claim 9 in which the first and second transfer means are arranged to grip different edge portions of the sheet stack.

11. A sheet handling apparatus as defined in claim 10 in which the edge portions of the sheet stack gripper by the first and second transfer means are perpendicular to each other.

12. A sheet handling apparatus as defined in claim 11 in which the second transfer means is movable between a retracted position and a projecting position in a direction perpendicular to the second direction.

13. A sheet handling apparatus as defined in claim 1 in which the second transfer means is normally held in a home position beside the handling tray.

14. A sheet handling apparatus as defined in claim 1 in which a reference surface on the accumulation tray on which the edge of the sheet stacks is defined on the accumulation tray is offset in the first direction from a reference surface on the handling tray on which the edge of the sheet stacks are defined on the handling tray.

15. A sheet handling apparatus as defined in claim 1 in which the second transfer means comprises upper and lower pinch levers which respectively presses the upper and lower surfaces of the sheet stack in a surface contact.

16. A sheet handling apparatus as defined in claim 1 in which the second transfer means releases the sheet stack onto the accumulation tray in a state where at least the edge portion gripped by the second transfer means is held horizontally.

17. A sheet handling apparatus which receives on a handling tray a plurality of sheets discharged from an image recording apparatus in a first direction, thereby forming a sheet stack of a series of sheets on the handling tray, and transfers the sheet stack onto an accumulation tray which is disposed with respect to the handling tray in a second direction which intersects the first direction, said sheet handling apparatus comprising:

a first transfer means which transfers the sheet stack on the handling tray toward the accumulation tray in the second direction and a second transfer means in the form of a gripper which grips the sheet stack at an edge portion on he image recording apparatus side, receives the sheet stack from the first transfer means after the first transfer means transfers the sheet stack by a predetermined distance in the second direction and transfers the sheet stack, the second transfer means is arranged to be able to move the sheet stack in a direction intersecting the second direction.

18. A sheet handling apparatus which receives on a handling tray a plurality of sheets discharged from an image recording apparatus in a first direction, thereby forming a sheet stack of a series of sheets on the handling tray, and transfers the sheet stack onto an accumulation tray which is disposed with respect to the handling tray in a second direction which intersects the first direction, said sheet handling apparatus comprising:

a first transfer means which transfers the sheet stack on the handling tray toward the accumulation tray in the second direction, and a second transfer means in the form of a gripper which grips the sheet stack at an edge portion on the image recording apparatus side, receives the sheet stack from the first transfer means after the first transfer means transfers the sheet stack by a predetermined distance in the second direction and transfers the sheet stack, wherein the gripper comprises a pair of pinch levers which are opened and closed by an opening and closing mechanism and are closed to press the sheet stack on opposite sides thereof, a rotating mechanism which rotates the pinch levers gripping therebetween the sheet stack to move the sheet stack in a direction intersecting the second direction, and a transfer mechanism which transfers the pinch levers in the second direction, wherein the pinch levers are closed by the opening and closing mechanism to grip the sheet stack in a home position of the second transfer means, where the second transfer means receives the sheet stack, transferred by the transfer mechanism to a release position gripping the sheet stack, rotated by the rotating mechanism in the direction intersecting the second direction, and opened to release the sheet stack onto the accumulation tray.

19. A sheet handling apparatus which receives on a handling tray a plurality of sheets discharged from an image recording apparatus in a first direction, thereby forming a sheet stack of a series of sheets on the handling tray, and transfers the sheet stack onto an accumulation tray which is disposed with respect to the handling tray in a second direction which intersects the first direction, said sheet handling apparatus comprising:

a first transfer means which transfers the sheet stack on the handling tray toward the accumulation tray in the second direction, a second transfer means in the form of a gripper which grips the sheet stack at an edge portion on the image recording apparatus side, receives the sheet stack from the first transfer means after the first transfer means transfers the sheet stack by a predetermined distance in the second direction and transfers the sheet stack, and a stapler which staples the sheet stack on the handling tray in first and second stapling positions in an edge portion of the sheet stack, and in which the second transfer means grips the portion of the sheet stack between the first and second stapling positions inclusive of the first stapling position when the stapler staples the sheet stack in the second stapling position after stapling in the first stapling position.

20. A sheet handling apparatus which receives on a handling tray a plurality of sheets discharged from an image recording apparatus in a first direction, thereby forming a sheet stack of a series of sheets on the handling tray, and transfers the sheet stack onto an accumulation tray which is disposed with respect to the handling tray in a second direction which intersects the first direction, said sheet handling apparatus comprising:

a first transfer means which transfers the sheet stack on the handling tray toward the accumulation tray in the second direction, a second transfer means in the form of a gripper which grips the sheet stack at an edge portion on the image recording apparatus side, receives the sheet stack from the first transfer means after the first transfer means transfers the sheet stack by a predetermined distance in the second direction and transfers the sheet stack, and a stapler which staples the sheet stack on the handling tray in first and second stapling positions in an edge portion of the sheet stack, and the second transfer means receives from the first transfer means a sheet stack which has been stapled in the first stapling position gripping the sheet stack at a portion between the first and second stapling positions inclusive of the first stapling position and transfers the sheet stack to bring the second stapling position to the stapler.

21. A sheet handling apparatus which receives on a handling tray a plurality of sheets discharged from an image recording apparatus, thereby forming a sheet stack of a series of sheets on the handling tray, and transfers the sheet stack onto an accumulation tray, said sheet handling apparatus comprising:

a first transfer means which transfers the sheet stack on the handling tray toward the accumulation tray, and a second transfer means in the form of a gripper which grips the sheet stack at an edge portion on the image recording apparatus side of the sheet stack, receives the sheet stack from the first transfer means after the first transfer means transfers the sheet stack by a predetermined distance and transfers the sheet stack, said first transfer means being movable while said second transfer means remains in a fixed position.

22. A sheet handling apparatus which receives on a handling tray a plurality of sheets discharged from an image recording apparatus, thereby forming a sheet stack of a series of sheets on the handling tray, and transfers the sheet stack onto an accumulation tray, said sheet handling apparatus comprising:

a first transfer means which grips the sheet stack along a first edge of the sheet stack and transfers the sheet stack on the handling tray toward the accumulation tray, and a second transfer means in the form of a gripper which grips the sheet stack along a second edge of the sheet stack that is perpendicular to the first edge of the sheet stack, the second transfer means receives the sheet stack from the first transfer means after the first transfer means transfers the sheet stack by a predetermined distance and transfers the sheet stack.

23. A sheet handling apparatus which receives on a handling tray a plurality of sheets discharged from an image recording apparatus, thereby forming a sheet stack of a series of sheets on the handling tray, and transfers the sheet stack onto an accumulation tray, said sheet handling apparatus comprising:

a first transfer means which transfers the sheet stack on the handling tray toward the accumulation tray, a second transfer means which receives the sheet stack from the first transfer means after the first transfer means transfers the sheet stack by a predetermined distance, and a stapler which staples the sheet stack in first and second stapling positions in an edge portion of the sheet stack, and the second transfer means receives from the first transfer means a sheet stack which has been stapled in the first stapling position gripping the sheet stack at a portion between the first and second stapling positions and transfers the sheet stack to bring the second stapling position to the stapler.

* * * * *

UNITED STATES PATENT AND TRADEMARK OFFICE

CERTIFICATE OF CORRECTION

PATENT NO. : 5,997,239

DATED : November 2, 1999

INVENTOR(S) : Chauffour et al.

It is certified that error appears in the above-identified patent and that said Letters Patent is hereby corrected as shown below:

On the Cover:

[73] Assignee: "CIE," should read -- Cie, --;

In the Claims:

Column 10, line 6: "25° C.;" should read -- 25° C., --;

In the Specification:

Column 8, line 30: "PVAC" should read -- PVAc --;

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,997,239
DATED : December 7, 1999
INVENTOR(S) : Hideki Mimura et al.

It is certified that error appears in the above-identified patent and that said Letters Patent is hereby corrected as shown below:

This certificate supersedes Certificate of Correction issued May 29, 2001, the number was erroneously mentioned and should be vacated since no Certificate of Correction was granted.

Signed and Sealed this

Twenty-ninth Day of June, 2004

JON W. DUDAS
*Acting Director of the United States Patent and Trademark Office*